US011603834B2

(12) United States Patent
Jeon et al.

(10) Patent No.: US 11,603,834 B2
(45) Date of Patent: Mar. 14, 2023

(54) LINEAR COMPRESSOR

(71) Applicant: LG Electronics Inc., Seoul (KR)

(72) Inventors: Wooju Jeon, Seoul (KR); Youngpil Kim, Seoul (KR); Kyungmin Lee, Seoul (KR); Sangik Son, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 17/065,958

(22) Filed: Oct. 8, 2020

(65) Prior Publication Data

US 2021/0102533 A1 Apr. 8, 2021

(30) Foreign Application Priority Data

Oct. 8, 2019 (KR) ..... 10-2019-0124433

(51) Int. Cl.
*F04B 39/00* (2006.01)
*F04B 19/22* (2006.01)
(Continued)

(52) U.S. Cl.
CPC ..... *F04B 39/0005* (2013.01); *F04B 39/0027* (2013.01); *F04B 17/04* (2013.01); *F04B 19/22* (2013.01); *F04B 53/003* (2013.01); *F04B 53/008* (2013.01); *F04B 53/145* (2013.01); *F04B 53/146* (2013.01)

(58) Field of Classification Search
CPC .. F04B 39/0005; F04B 39/0027; F04B 53/14; F04B 19/22; F04B 39/0044; F04B 53/003; F04B 53/008; F04B 53/02; F04B 53/144; F04B 53/145; F04B 53/146; F04B 39/0016; F04B 35/045; F04B 39/0292; F04B 39/127; F04B 39/0061; F04B 39/123
See application file for complete search history.

(56) References Cited

U.S. PATENT DOCUMENTS 4,121,125 A 10/1978 Dolz
6,174,141 B1 * 1/2001 Song ..... F04B 39/0055 417/312
9,534,591 B2 1/2017 Roettger et al.
2008/0008606 A1 1/2008 Muth et al.
2009/0280015 A1 11/2009 Lillie et al.
(Continued)

FOREIGN PATENT DOCUMENTS

CN 104251192 10/2016
EP 3239521 11/2017
(Continued)

OTHER PUBLICATIONS hannarubbercompany.com; Durometer _ Rubber Hardness _ Shore A _ Shore D _ Hanna Rubber Co pdf from hannarubbercompany.com/durometer/ (Year: 2022).*
(Continued)

*Primary Examiner* — Kenneth J Hansen
*Assistant Examiner* — David N Brandt
(74) *Attorney, Agent, or Firm* — Fish & Richardson P.C.

(57) ABSTRACT

A compressor is disclosed. A compressor according to the present discloser includes a piston structure which has a guide member reciprocating inside a cylinder in an axial direction, and a magnet frame which supports a mover moving together with the piston structure, in which the piston structure includes the guide member, a mount member connected to the magnet frame, and an elastic member provided between the guide member and the mount member and capable of elastic deformation.

10 Claims, 11 Drawing Sheets

(51) Int. Cl.

| | |
|---|---|
| ***F04B 17/04*** | (2006.01) |
| ***F04B 53/00*** | (2006.01) |
| ***F04B 53/14*** | (2006.01) |

(56) References Cited

U.S. PATENT DOCUMENTS

| | | | | |
|---|---|---|---|---|
| 2015/0004014 | A1* | 1/2015 | Kim | F04B 39/0027 417/312 |
| 2015/0369297 | A1* | 12/2015 | Graf | F16D 3/56 464/81 |
| 2017/0298913 | A1 | 10/2017 | Kim et al. | |

FOREIGN PATENT DOCUMENTS

| | | | | |
|---|---|---|---|---|
| KR | 1020040080447 | | 9/2004 | |
| KR | 20090041718 | | 4/2009 | |
| KR | 1020090105469 | | 10/2009 | |
| KR | 101412584 | * | 6/2014 | F04B 35/045 |
| KR | 1020150040053 | | 4/2015 | |
| KR | 1020180035612 | | 4/2018 | |

OTHER PUBLICATIONS

KR101412584 translation (Year: 2022).*

EP Extended Search Report in European Appln. No. 20200757.1, dated Nov. 16, 2020, 3 pages.

Office Action in Chinese Appln. No. 202011045052.2, dated Mar. 31, 2022, 14 pages (with English translation).

Notice of Allowance in Korean Appln. No. 10-2019-0124433, dated Dec. 16, 2020, 5 pages (with English translation).

* cited by examiner

LINEAR COMPRESSOR

CROSS-REFERENCE TO RELATED APPLICATION

This application is based on and claims the benefit of priority to Korean Patent Application No. 10-2019-0124433, filed on Oct. 8, 2019, in the Korean Intellectual Property Office, the disclosure of which is incorporated herein in its entirety by reference.

TECHNICAL FIELD

The present discloser relates to a compressor. More specifically, the present specification relates to a linear compressor that compresses refrigerant by a linear reciprocating motion of a piston.

BACKGROUND

In general, a compressor refers to a device configured to compress a working fluid such as air or refrigerant by receiving power from a power generating device such as a motor or a turbine. Compressors are widely applied to the whole industry or home appliances, in particular, a steam compression refrigeration cycle (hereinafter referred to as a 'refrigeration cycle').

These compressors may be classified into a reciprocating compressor, a rotary compressor, and a scroll compressor according to a method of compressing refrigerant.

The reciprocating compressor is a compressor operated by a method in which a compression space is formed between the piston and the cylinder and the piston linearly reciprocates to compress a fluid, the rotary compressor is a compressor operated by a method in which fluid is compressed by a roller eccentrically rotated inside the cylinder, and the scroll compressor is a compressor operated by a method of interlocking and rotating a pair of spiral scrolls to compress a fluid.

Recently, among the reciprocating compressors, the use of a linear compressor using a linear reciprocating motion without a crankshaft has gradually increased. The linear compressor has the advantage of improving the efficiency of the compressor because there is little mechanical loss associated with converting rotational motion to linear reciprocating motion and having a relatively simple structure.

In the linear compressor, a cylinder is located inside a casing forming an enclosed space to form a compression chamber, and a piston covering the compression chamber is configured to reciprocate inside the cylinder. In a linear compressor, a process in which fluid in the enclosed space is suctioned into the compression chamber while the piston is located at the bottom dead center (BDC) and the fluid in the compression chamber is compressed and discharged while the piston is located at the top dead center (TDC) is repeated.

A compression unit and a driving unit are respectively installed inside the linear compressor, and the compression unit performs a process of compressing and discharging the refrigerant while performing a resonance motion by a resonance spring through the movement generated by the driving unit.

The linear compressor repeatedly performs a series of processes in which the refrigerant is discharged from the compression space by the forward motion of the piston and is moved to the condenser through the discharge pipe after the refrigerant is suctioned in the casing through the suction pipe while the piston reciprocates at high speed inside a cylinder by a resonance spring.

Referring to FIGS. 2A and 2B, when misalignment occurs in the piston, the piston reciprocates the inside of the cylinder while being eccentric or inclined. When the piston contacts the cylinder, wear occurs on the piston and the cylinder, particles are generated, and when fatigue accumulates, the piston may be damaged. To prevent this, there is a need to reduce the size of the contact pressure by applying a flexible structure to the movable part of the piston.

U.S. Pat. No. 9,534,591B which is the prior art attempts to solve this problem by inserting a flexible rod into the piston in the longitudinal direction. However, the flexible rod still has a problem of losing the flexible function thereof due to fatigue failure generated by the repeated action of an external force.

In addition, there have been efforts to solve this problem by joint-coupling pistons. However, even in a case of using the joint, since a lubricant has to be used according to the operating conditions, the manufacturing cost increases, and even in a case of the joint, there is still a problem that the function of the flexible structure is lost if a clearance occurs as fatigue increases.

PRIOR ART

Patent Document 1
U.S. Pat. No. 9,534,591B (published on Feb. 3, 2017)

SUMMARY

An object of the present discloser is to provide a compressor capable of improving compression reliability by preventing the piston from being in contact with the inner wall of the cylinder or reducing a contact pressure acting on the piston since a flexible structure with strong fatigue durability in the coupling structure between the piston and the cylinder is added and thus the piston can be aligned only with the pressure generated on the lubrication surface.

Particular implementations of the present disclosure provide a compressor that includes a piston structure and a magnet frame. The piston structure includes a guide member. The guide member may be configured to reciprocate inside a cylinder. The magnet frame supports a mover. The mover is configured to move together with the piston structure. The piston structure may include a mount member that is connected to the magnet frame, and an elastic member that is disposed between the guide member and the mount member and configured to elastically deform.

In some implementations, the compressor can optionally include one or more of the following features. At least a portion of the elastic member may have an annular shape. An outer circumferential surface of the elastic member may be coupled to one of the guide member or the mount member. An inner circumferential surface of the elastic member may be coupled to the other of the guide member or the mount member. The guide member may include a guide that has a cylindrical shape, a head that is disposed at a first side of the guide and configured to compress a compression space inside the cylinder, and a first coupling part that is disposed at a second side of the guide and coupled to the inner circumferential surface of the elastic member. The second side may be opposite to the first side. The mount member may include a mount member body part that at least partially surrounds the elastic member, a frame coupling part that extends from the mount member body part in an outer radial direction and is connected to the magnet frame, and a second coupling part that is disposed at an inner circumferential surface of the mount member body part. The elastic member may include an inner coupling part that is coupled to the first coupling part of the guide member on the inner circumferential surface of the elastic member. The elastic member may include an outer coupling part that is coupled to the second coupling part of the mount member body part on the outer circumferential surface of the elastic member. The guide member may include a guide that has a cylindrical shape, a head that is disposed at a first side of the guide and configured to compress a compression space inside the cylinder, and a first coupling part that is defined at an inner circumferential surface of the guide and coupled to an outer circumferential surface of the elastic member. The mount member may include a support plate that is connected to the magnet frame, a mount member extension part that extends from the support plate and is received in the guide, and a second coupling part that is disposed at an outer circumferential surface of the mount member extension part and coupled to an inner circumferential surface of the elastic member. An end of the guide member may be spaced apart from the support plate. The elastic member may include an inner coupling part that is coupled to the first coupling part of the guide member on the outer circumferential surface of the elastic member. The elastic member includes an outer coupling part that is coupled to the second coupling part of the mount member extension part on the inner circumferential surface of the elastic member. The compressor may include a muffler structure that defines a passage through which a refrigerant that is suctioned from a suction pipe passes. The support plate is disposed between the guide member and the muffler structure and defines a first communication hole that passes through the support plate. The refrigerant flows from the muffler structure into a suction space inside the guide member through the first communication hole. The mount member extension part may include a mount bar that has a bar shape, and a coupling plate that extends in a radial direction from the mount bar and includes the second coupling part that is coupled to the inner circumferential surface of the elastic member. The coupling plate may define a second communication hole through which the refrigerant that is suctioned into the guide member passes. The mount member extension part may include a hollow pipe through which the refrigerant passes. The second coupling part may be coupled to the inner circumferential surface of the elastic member and disposed at the outer circumferential surface of the mount member extension part. The elastic member may have an annular shape. An outer coupling part may be disposed circumferentially at an outer circumferential surface of the elastic member. An inner coupling part may be disposed circumferentially at an inner circumferential surface of the elastic member. The outer coupling part may include an outer coupling groove or an outer coupling protrusion that is coupled to one of the guide member or the mount member. The inner coupling part may include an inner coupling groove or an inner coupling protrusion that is coupled to the other of the guide member or the mount member. An inner sliding passage may be (i) configured to receive the coupling protrusion that is positioned at one of the guide member or the mount member and (ii) defined at an inner locking jaw that is located at a side of the inner coupling groove of the elastic member. A sliding passage may be (i) configured to receive the outer coupling protrusion of the elastic member and (ii) defined at a locking jaw that is located at a side of a coupling groove defined at the other of the guide member or the mount member. An outer sliding passage may be (i) configured to receive a coupling protrusion that is positioned at an inner circumferential surface of the other of the guide member or the mount member and (ii) defined at an outer locking jaw that is located at a side of the outer coupling groove of the elastic member. A sliding passage may be (i) configured to receive the outer coupling protrusion of the elastic member and (ii) defined at a locking jaw that is located at a side of a coupling groove defined at an inner circumferential surface of the other of the guide member or the mount member. The elastic member may include an inner sliding passage and a first stopper. The inner sliding passage may be defined at an inner locking jaw located at a side of the inner coupling groove and configured to receive a first coupling protrusion positioned at an outer circumferential surface of one of the guide member or the mount member. The first stopper may protrude from the inner coupling groove and prevents rotation of the first coupling protrusion. The elastic member may include an outer sliding passage and a second stopper. The outer sliding passage may be defined at an outer locking jaw located at a side of the outer coupling groove and configured to receive a second coupling protrusion positioned at an inner circumferential surface of the other of the guide member or the mount member. The second stopper may protrude from the outer coupling groove and prevent rotation of the second coupling protrusion. The elastic member may be configured to deform based on tilting of the guide member in a radial direction and rotation of the guide member in a rotation direction. The elastic member may include a rubber material that has a shore hardness of 30 or more. The elastic member may define the outer coupling groove and the inner coupling groove. A width of the outer coupling groove may be 1.5 or more times a depth of the outer coupling groove. A width of the inner coupling groove may be 1.5 or more times the depth of the inner coupling groove.

A compressor according to an embodiment of the present discloser includes a piston structure which has a guide member reciprocating inside a cylinder in an axial direction, and a magnet frame which supports a driving part driving the piston structure (or a magnet frame which supports a mover moving together with the piston structure), in which the piston structure may include the guide member; a mount member connected to the magnet frame; and an elastic member provided between the guide member and the mount member and capable of elastic deformation.

In addition, the elastic member may be provided in an annular or annular partial shape, an outer circumferential surface of the elastic member may be coupled to any one of the guide member and the mount member, and an inner circumferential surface of the elastic member may be coupled to the other one of the guide member and the mount member.

In addition, the guide member may include a guide having a cylindrical shape, a head provided in front of the guide and compressing a compression space inside the cylinder, and a first coupling part provided in rear of the guide and coupled to the inner circumferential surface of the elastic member.

At this time, the mount member may include a mount member body part surrounding all or a part of the elastic member, a frame coupling part extending in an outer radial direction of the mount member body part and connected to the magnet frame, and a second coupling part provided in an inner circumferential surface of the mount member body part.

At this time, the elastic member may be provided with an inner coupling part coupled to the first coupling part of the guide member on the inner circumferential surface thereof, and the elastic member may be provided with an outer coupling part coupled to the second coupling part of the mount member body part on an outer circumferential surface thereof.

At this time, the guide member may include a guide having a cylindrical shape, a head provided in front of the guide and compressing a compression space inside the cylinder, and a first coupling part formed on an inner circumferential surface of the guide and coupled to an outer circumferential surface of the elastic member.

Here, the mount member may include a support plate connected to the magnet frame, a mount member extension part extending forward from the support plate and received in the guide, and a second coupling part provided on an outer circumferential surface of the mount member extension part and coupled to an inner circumferential surface of the elastic member.

Here, a rear end part of the guide member may be disposed to be spaced apart from the support plate.

In addition, the elastic member may have an outer coupling part coupled to the first coupling part of the guide member on the outer circumferential surface thereof, and the elastic member may have an outer coupling part coupled to the second coupling part of the mount member extension part on the inner circumferential surface thereof.

In addition, the compressor may further include a muffler structure located at the rear of the piston structure and forming a passage through which refrigerant suctioned from a suction pipe passes, in which the support plate may be disposed between the guide member and the muffler structure and may be provided with a first communication hole which passes through the support plate so that the refrigerant of the muffler structure flows into a suction space inside the guide member through the first communication hole.

In addition, the mount member extension part may include a mount bar provided in a bar shape and a coupling plate extending in a radial direction from the mount bar and which has the second coupling part coupled to the inner circumferential surface of the elastic member.

Here, the coupling plate may have a second communication hole through which the refrigerant suctioned into the guide member passes.

In addition, the mount member extension part may be provided in a form of a hollow pipe through which the refrigerant passes and has the second coupling part which is coupled to the inner circumferential surface of the elastic member and formed on the outer circumferential surface of the mount member extension part.

In addition, the elastic member may be provided in an annular shape, an outer coupling part formed in a circumferential direction may be provided on an outer circumferential surface of the elastic member, an inner coupling part formed in a circumferential direction may be provided on an inner circumferential surface of the elastic member, the outer coupling part may include an outer coupling groove or an outer coupling protrusion, coupled to any one of the guide member and the mount member, and the inner coupling part may include an inner coupling groove or an inner coupling protrusion, coupled to the other one of the guide member and the mount member.

At this time, an inner sliding passage through which the coupling protrusion formed on any one of the guide member and the mount member is capable of passing may be formed on an inner locking jaw located at one side of the inner coupling groove of the elastic member, or a sliding passage through which the outer coupling protrusion of the elastic member is capable of passing may be formed on a locking jaw located at one side of a coupling groove formed on the other one of the guide member and the mount member.

In addition, an outer sliding passage through which a coupling protrusion formed on an inner circumferential surface of the other one of the guide member and the mount member is capable of passing may be formed on an outer locking jaw located at one side of the outer coupling groove of the elastic member, or a sliding passage through which the outer coupling protrusion of the elastic member is capable of passing may be formed on a locking jaw located at one side of a coupling groove formed on an inner circumferential surface of the other one of the guide member and the mount member.

In addition, the elastic member may be provided with an inner sliding passage which is formed on an inner locking jaw located at one side of the inner coupling groove and through which a first coupling protrusion formed on an outer circumferential surface of any one of the guide member and the mount member is capable of passing and an inner stopper (first stopper) which protrudes from the inner coupling groove and configured to prevent rotation of the first coupling protrusion, or the elastic member may be provided with an outer sliding passage which is formed on an outer locking jaw located at one side of the outer coupling groove and through which a second coupling protrusion formed on an inner circumferential surface of the other one of the guide member and the mount member is capable of passing and an outer stopper (second stopper) which protrudes from the outer coupling groove and configured to prevent rotation of the second coupling protrusion.

In addition, the elastic member may be configured to allow deformation according to tilting of the guide member in a radial direction and rotation thereof in a rotation direction.

Here, the elastic member may be provided with a rubber material having a shore hardness of 30 or more.

In addition, the elastic member may be formed with the outer coupling groove and the inner coupling groove, the width of the outer coupling groove may be provided to have a value of 1.5 or more of the depth of the outer coupling groove, and the width of the inner coupling groove may be provided to have a value of 1.5 or more of the depth of the inner coupling groove.

DETAILED DESCRIPTION OF THE EMBODIMENTS

Figure 1:
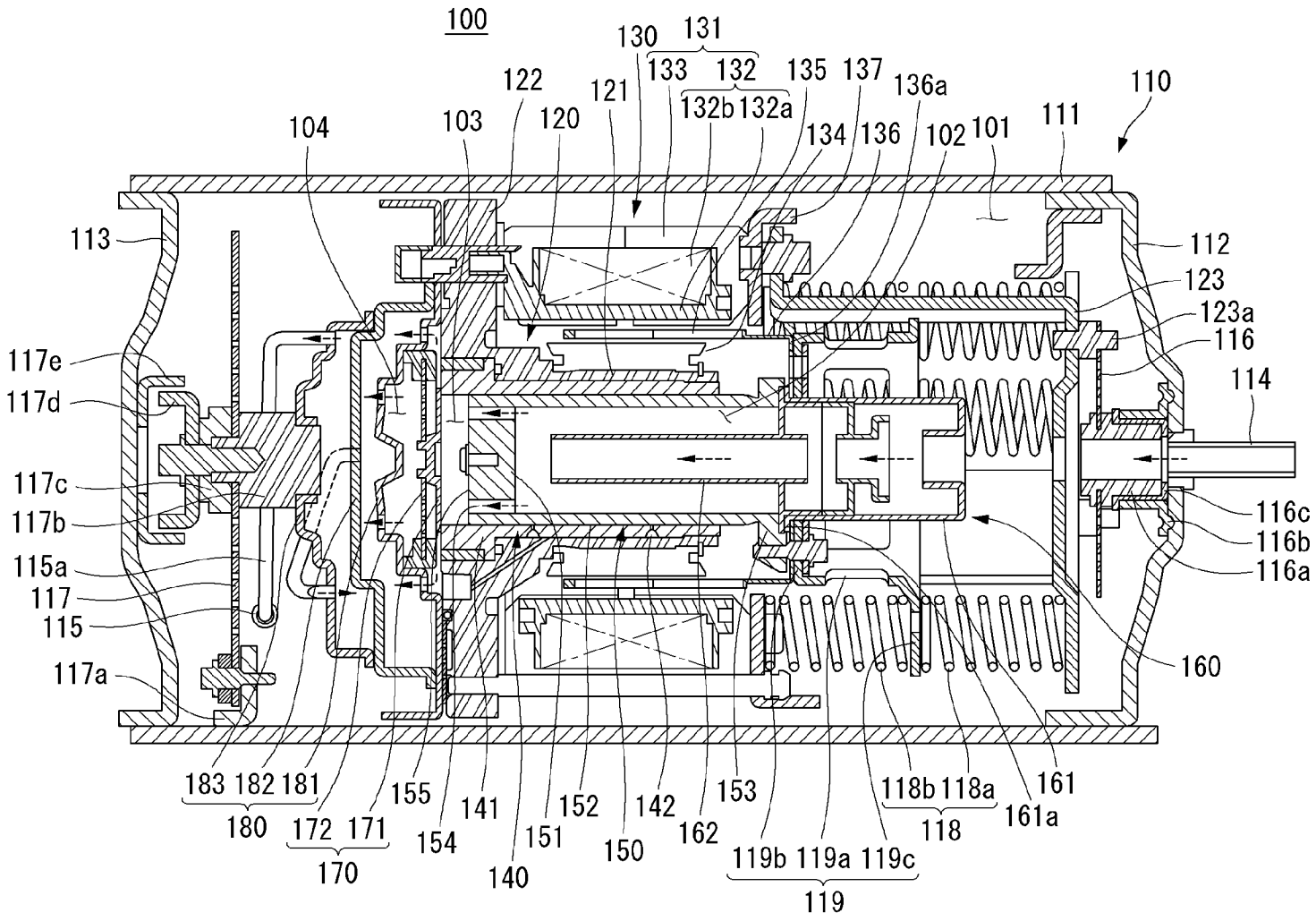
FIG. 1 is a cross-sectional view for explaining the structure of a compressor.
Figure 2A:
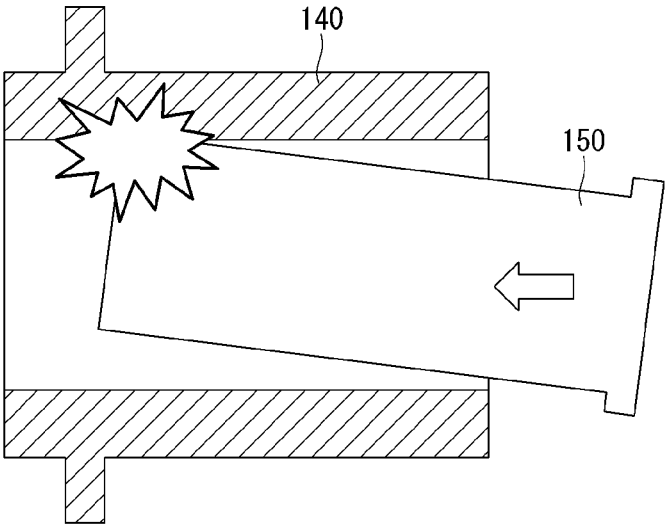
FIGS. 2A and 2B are views illustrating a state where the piston contacts the cylinder.
Figure 2B:
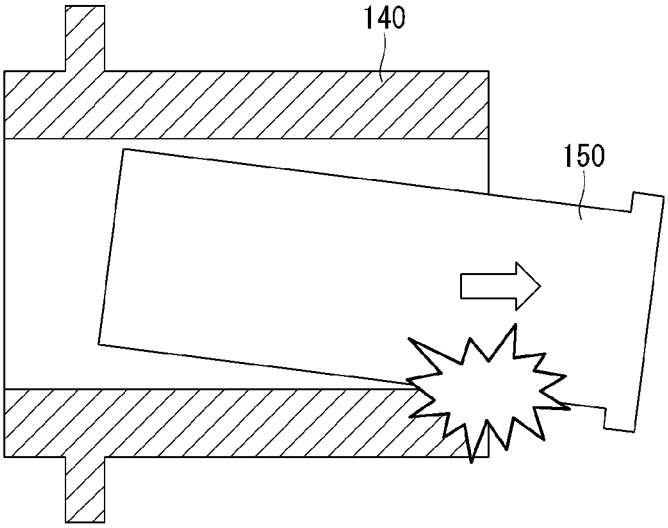

Hereinafter, embodiments disclosed in the present discloser will be described in detail with reference to the accompanying drawings, but identical or similar components are denoted by the same reference numerals regardless of reference numerals, and redundant descriptions thereof will be omitted.

In describing embodiments disclosed in the present specification, when a component is referred to as being "connected" or "linked" to another component, a component may be directly connected or linked to another component, but it should be understood that other components may exist therebetween.

In addition, in describing embodiments disclosed in the present specification, when it is determined that detailed descriptions of related known technologies may obscure the subject matter of embodiments disclosed in the present specification, detailed descriptions thereof will be omitted. In addition, it should be understood that the accompanying drawings are only for easy understanding of embodiments disclosed in the present discloser, and the technical idea disclosed in the present specification is not limited by the accompanying drawings, and include all modifications, equivalents to substitutes included in the spirit and the technical scope of the present discloser.

Meanwhile, terms of the discloser may be replaced with terms such as document, specification, and description.

FIG. 1 is a cross-sectional view for explaining the structure of the compressor 100.

Hereinafter, the compressor according to the present discloser will be described, as an example, a linear compressor that suctions and compresses a fluid and, discharges the compressed fluid while a piston performs a linear reciprocating motion.

The linear compressor may be a component of a refrigeration cycle, and the fluid compressed in the linear compressor may be a refrigerant circulating in the refrigeration cycle. In addition to the compressor, the refrigeration cycle includes a condenser, an expansion device, and an evaporator. The linear compressor may be used as a component of a cooling system of a refrigerator, but is not limited thereto, and may be widely used throughout the industry.

Referring to FIG. 1, the compressor 100 may include a casing 110 and a main body received in the casing 110, and the main body includes a frame 120, a cylinder 140 fixed to the frame 120, a piston 150 for linearly reciprocating the inside of the cylinder 140, a driving unit 130 which is fixed to the frame 120 and imparts a driving force to the piston 150, and the like. Here, the cylinder 140 and the piston 150 may be referred to as compression units 140 and 150.

The compressor 100 may be provided with a bearing means for reducing friction between the cylinder 140 and the piston 150. The bearing means may be oil bearings or gas bearings. Alternatively, a mechanical bearing may be used as a bearing means.

The main body of the compressor 100 may be elastically supported by support springs 116 and 117 installed on both end parts inside the casing 110. The support spring includes a first support spring 116 for supporting the rear of the main body and a second support spring 117 for supporting the front of the main body and may be provided as a leaf spring. The support springs 116 and 117 may absorb vibrations and shocks generated by the reciprocating motion of the piston 150 while supporting the internal components of the main body.

The casing 110 may form an enclosed space, and the enclosed space includes a receiving space 101 in which the suctioned refrigerant is received, a suction space 102 filled with the refrigerant before being compressed, and a compression space 103 for compressing the refrigerant, and a discharge space 104 filled with the compressed refrigerant.

In other words, the refrigerant suctioned from the suction pipe 114 connected to the rear side of the casing 110 is filled in the receiving space 101, and the refrigerant in the suction space 102 communicating with the receiving space 101 is compressed in the compression space 103, discharged to the discharge space 104, and discharged to the outside through a discharge pipe 115 connected to the front side of the casing 110.

The casing 110 has a shell 111 formed in an elongated cylindrical shape in a substantially transverse direction with both ends opened, a first shell cover 112 coupled to the rear side of the shell 111, and a second shell cover 113 coupled to the front side. Here, the front side denotes a direction in which the compressed refrigerant is discharged to the left side of the drawing, and the rear side denotes a direction in which the refrigerant flows to the right side of the drawing. In addition, the first shell cover 112 or the second shell cover 113 may be formed integrally with the shell 111.

The casing 110 may be formed of a thermally conductive material. Through this, the heat generated in the inner space of the casing 110 may be quickly radiated to the outside.

The first shell cover 112 is coupled to the shell 111 to seal the rear side of the shell 111, and a suction pipe 114 is inserted in the center of the first shell cover 112 to be coupled.

In addition, the rear side of the main body of the compressor 100 may be elastically supported in the radial direction to the first shell cover 112 through the first support spring 116.

The first support spring 116 may be provided as a circular leaf spring, an edge part thereof may be supported by a back cover 123 in the front direction through a support bracket 123*a*, and an opened central part thereof may be supported by the first shell cover 112 in the rear direction through the suction guide 116*a*.

The suction guide 116*a* is formed in a cylindrical shape in which a through-flow path is provided. The suction guide 116*a* may have a central opening part of the first support spring 116 coupled to the front outer circumferential surface, and the rear end part thereof may be supported by the first shell cover 112. In this case, a separate suction-side support member 116*b* may be interposed between the suction guide 116*a* and the inner surface of the first shell cover 112.

The rear side of the suction guide 116*a* may communicate with the suction pipe 114, and the refrigerant suctioned through the suction pipe 114 may pass through the suction guide 116*a* and may smoothly flow into the muffler unit 160, which will be described later.

A damping member 116*c* made of a rubber material or the like may be installed between the suction guide 116*a* and the suction-side support member 116*b*. Accordingly, it is possible to block the transmission of vibrations that may occur while the refrigerant is suctioned through the suction pipe 114 to the first shell cover 112.

The second shell cover 113 may be coupled to the shell 111 to seal the front side of the shell 111, and the discharge pipe 115 may be inserted and coupled through a loop pipe 115*a*. The refrigerant discharged from the compression space 103 may pass through a discharge cover assembly 180 and then be discharged to the refrigeration cycle through the loop pipe 115*a* and the discharge pipe 115.

The front side of the compressor main body may be elastically supported in the radial direction to the shell 111 or the second shell cover 113 through the second support spring 117.

The second support spring 117 may be provided as a circular leaf spring, and the opened central part thereof is supported by the discharge cover assembly 180 in the rear direction through a first support guide 117*b*, and the edge part thereof may be supported on the inner surface of the shell 111 or the inner circumferential surface of the shell 111 adjacent to the second shell cover 113 in the radial direction. Alternatively, unlike the drawings, the edge part of the second support spring 117 may be supported by the second shell cover 113 in the front direction through a bracket (not illustrated).

The first support guide 117*b* is formed in a continuous cylindrical shape with different diameters, the front side thereof may be inserted into the central opening of the second support spring 117, and the rear side thereof is inserted into the central opening of the discharge cover assembly 180. In addition, the support cover 117*c* may be coupled to the front side of the first support guide 117*b* with the second support spring 117 interposed therebetween. In addition, a cup-shaped second support guide 117*d* which is recessed forward is coupled to the front side of the support cover 117*c*, and a cup-shaped third support guide 117*e* which corresponds to the second support guide 117*d* and is recessed backward may be coupled to the inside of the second shell cover 113. The second support guide 117*d* may be inserted into the third support guide 117*e* to be supported in an axial direction and a radial direction. In this case, a gap may be formed between the second support guide 117*d* and the third support guide 117*e*.

The frame 120 includes a body part 121 supporting an outer circumferential surface of the cylinder 140 and a flange part 122 connected to one side of the body part 121 and supporting the driving unit 130. The frame 120 may be elastically supported by the casing 110 by the first support spring 116 and the second support spring 117 together with the driving unit 130 and the cylinder 140.

The body part 121 may be formed in a cylindrical shape surrounding the outer circumferential surface of the cylinder 140, and the flange part 122 may be formed to extend in a radial direction from the front end part of the body part 121.

The cylinder 140 may be coupled to the inner circumferential surface of the body part 121, and an inner stator 134 may be coupled to the outer circumferential surface thereof. For example, the cylinder 140 may be fixed by press-fitting to the inner circumferential surface of the body part 121 and the inner stator 134 may be fixed using a fixing ring.

An outer stator 131 may be coupled to the rear surface of the flange part 122, and the discharge cover assembly 180 may be coupled to the front surface thereof. For example, the outer stator 131 and the discharge cover assembly 180 may be fixed through a mechanical coupling means.

A bearing inlet groove 125*a* forming a part of the gas bearing is formed on one side of the front surface of the flange part 122, a bearing communication hole 125*b* penetrating from the bearing inlet groove 125*a* to the inner circumferential surface of the body part 121 is formed, and the gas groove 125*c* communicated with the bearing communication hole 125*b* may be formed on the inner circumferential surface of the body part 121.

The bearing inlet groove 125*a* is formed by being recessed in the axial direction to a predetermined depth, and the bearing communication hole 125*b* is a hole having a smaller cross-sectional area than the bearing inlet groove 125*a* and may be formed to be inclined toward the inner circumferential surface of the body part 121. The gas groove 125*c* may be formed in an annular shape having a predetermined depth and an axial length on the inner circumferential surface of the body part 121. Alternatively, the gas groove 125*c* may be formed on the outer circumferential surface of the cylinder 140 where the inner circumferential surface of the body part 121 contacts or may be formed on both the inner circumferential surface of the body part 121 and the outer circumferential surface of the cylinder 140.

Further, a gas inflow port 142 corresponding to the gas groove 125*c* may be formed on the outer circumferential surface of the cylinder 140. The gas inflow port 142 forms a kind of nozzle part in the gas bearing.

Meanwhile, the frame 120 and the cylinder 140 may be made of aluminum or aluminum alloy.

The cylinder 140 may be formed in a cylindrical shape with both end parts open, the piston 150 is inserted through the rear end part of the cylinder 140, and the front end part thereof may be closed by a discharge valve assembly 170. A compression space 103 surrounded by the cylinder 140, a front end part (head 151) of the piston 150, and the discharge valve assembly 170 may be formed. The volume of the compression space 103 increases when the piston 150 moves backward and the volume of the compression space 103 decreases as the piston 150 moves forward. In other words, the refrigerant flowing into the compression space 103 is compressed while the piston 150 moves forward and may be discharged through a discharge valve assembly 170.

The cylinder 140 may have a front end part bent outward to form a flange part 141. The flange part 141 of the cylinder 140 may be coupled to the frame 120. For example, a flange groove corresponding to the flange part 141 of the cylinder 140 may be formed at the front end part of the frame 120, and the flange part 141 of the cylinder 140 may be inserted into the flange groove and may be coupled through a mechanical coupling member.

Meanwhile, a gas bearing means capable of lubricating gas between the cylinder 140 and the piston 150 by supplying discharge gas at an interval between the outer circumferential surface of the piston 150 and the outer circumferential surface of the cylinder 140 may be provided. The discharge gas between the cylinder 140 and the piston 150 provides a levitation force to the piston 150 to reduce the friction of the piston 150 against the cylinder 140.

For example, a gas inflow port 142 which communicates with the gas groove 125*c* formed on the inner circumferential surface of the body part 121 and guides the compressed refrigerant passing through the cylinder 140 in the radial direction and flowing into the gas groove 125*c* between the inner circumferential surface of the cylinder 140 and the outer circumferential surface of the piston 150 may be formed in the cylinder 140. Alternatively, in consideration of the convenience of processing, the gas groove 125*c* may be formed on the outer circumferential surface of the cylinder 140.

The inlet of the gas inflow port 142 may be relatively wide, and the outlet thereof may be formed as a fine through-hole to serve as a nozzle. A filter (not illustrated) may be additionally provided at the inlet of the gas inflow port 142 to block the inflow of foreign substances. The filter may be a mesh filter made of metal or may be formed by winding a member such as a fine thread.

A plurality of gas inflow ports 142 may be independently formed, or an inlet may be formed as an annular groove and a plurality of outlets may be formed along the annular groove at a predetermined interval.

In addition, the gas inflow port 142 may be formed only on the front side with respect to the middle of the cylinder 140 in the axial direction or may be also formed at the rear side together at the front side in consideration of the sagging of the piston 150.

The piston 150 is inserted into the open end part of the rear of the cylinder 140 and is provided to seal the rear of the compression space 103.

The shape of the piston 150 may be a shape corresponding to the shape of the inner circumferential surface of the cylinder 140 to enable a reciprocating motion inside the cylinder 140.

As an example, the piston 150 may be provided in a cylindrical shape.

The piston 150 includes a head 151 which has a disk shape to divide the compression space 103 and a cylindrical guide 152 extending rearward from the outer circumferential surface of the head 151.

The head 151 may be provided to be partially opened, and the guide 152 may be provided to have a hollow shape, and the front of the guide 152 is partially sealed by the head 151, but the rear thereof is opened to be connected to the muffler unit 160. The head 151 may be provided as a separate member coupled to the guide 152, or the head 151 and the guide 152 may be integrally formed.

A suction port 154 is formed through the head 151 of the piston 150. The suction port 154 is provided to communicate the suction space 102 and the compression space 103 inside the piston 150. For example, the refrigerant flowing from the receiving space 101 to the suction space 102 inside the piston 150 may pass through the suction port 154 and be suctioned to the compression space 103 between the piston 150 and the cylinder 140.

The suction port 154 may extend in the axial direction of the piston 150. Alternatively, the suction port 154 may be formed to be inclined in the axial direction of the piston 150. For example, the suction port 154 may extend so as to incline in a direction away from the central axis toward the rear of the piston 150.

The suction port 154 may have a circular opening and a constant inner diameter. Alternatively, the suction port 154 may be formed as a long hole in which the opening extends in the radial direction of the head 151 or may be formed such that the inner diameter thereof increases toward the rear.

A plurality of suction ports 154 may be formed in one or more of a radial direction and a circumferential direction of the head 151.

In addition, a suction valve 155 for selectively opening and closing the suction port 154 may be mounted on the head 151 of the piston 150 adjacent to the compression space 103. The suction valve 155 may be operated by elastic deformation to open or close the suction port 154. In other words, the suction valve 155 may be elastically deformed to open the suction port 154 by the pressure of the refrigerant flowing into the compression space 103 through the suction port 154.

Further, the piston 150 is connected to a mover 135, and the mover 135 reciprocates in the front and rear direction according to the movement of the piston 150. The inner stator 134 and the cylinder 140 may be located between the mover 135 and the piston 150.

The piston 150 may be connected to the magnet frame 136 on which the mover 135 is installed.

In other words, the mover 135 and the piston 150 may be connected by a magnet frame 136 formed by bypassing the cylinder 140 and the inner stator 134 to the rear.

The muffler unit 160 is coupled to the rear of the piston 150 and is provided to attenuate noise generated during the process in which the refrigerant is suctioned to the piston 150. The refrigerant suctioned through the suction pipe 114 flows through the muffler unit 160 to the suction space 102 inside the piston 150.

The muffler unit 160 includes a suction muffler 161 communicating with the receiving space 101 of the casing 110, and an inner guide 162 connected to the front of the suction muffler 161 and guiding the refrigerant to the suction port 154.

The suction muffler 161 is located at the rear of the piston 150, the rear opening is disposed adjacent to the suction pipe 114, and the front end part may be coupled to the rear of the piston 150. The suction muffler 161 has a flow path formed in the axial direction to guide the refrigerant in the receiving space 101 to the suction space 102 inside the piston 150.

In this case, a plurality of noise spaces divided by baffles may be formed inside the suction muffler 161. The suction muffler 161 may be formed by coupling two or more members to each other, and for example, a second suction muffler may be press-fitted inside the first suction muffler to form a plurality of noise spaces. The suction muffler 161 may be formed of plastic material in consideration of weight or insulation.

The inner guide 162 may have a pipe shape in which one side thereof communicates with the noise space of the suction muffler 161 and the other side thereof is deeply inserted into the piston 150. The inner guide 162 may be formed in a cylindrical shape in which both ends are provided with the same inner diameter, but in some cases, the inner diameter of the front end which is the discharge side may be larger than the inner diameter of the rear end which is the opposite side thereto.

The suction muffler 161 and the inner guide 162 may be provided in various forms, through which the pressure of the refrigerant passing through the muffler unit 160 can be adjusted. In addition, the suction muffler 161 and the inner guide 162 may be integrally formed.

The discharge valve assembly 170 may include a discharge valve 171 and a valve spring 172 provided at a front side of the discharge valve 171 to elastically support the discharge valve 171. The discharge valve assembly 170 may selectively discharge the refrigerant compressed in the compression space 103. Here, the compression space 103 may be understood as a space formed between the suction valve 155 and the discharge valve 171.

The discharge valve 171 is disposed to be capable of being supported on the front surface of the cylinder 140 and may be mounted to selectively open and close the front opening of the cylinder 140. The discharge valve 171 may be operated by elastic deformation to open or close the compression space 103. The discharge valve 171 may be elastically deformed to open the compression space 103 by the pressure of the refrigerant flowing into the discharge space 104 through the compression space 103. For example, in a state where the discharge valve 171 is supported on the front surface of the cylinder 140, the compression space 103 is kept closed, and in a state where the discharge valve 171 is spaced apart from the front surface of the cylinder 140, the compressed refrigerant in the compression space 103 may be discharged to the opened space.

The valve spring 172 is provided between the discharge valve 171 and the discharge cover assembly 180 to provide an elastic force in the axial direction. The valve spring 172 may be provided as a compression coil spring or may be provided as a leaf spring in consideration of occupied space or reliability.

When the pressure in the compression space 103 is equal to or greater than the discharge pressure, the valve spring 172 deforms forward to open the discharge valve 171, and the refrigerant is discharged from the compression space 103 to be discharged to the first discharge space 103*a* of the discharge cover assembly 180. In addition, when the discharge of the refrigerant is completed, the valve spring 172 provides a restoring force to the discharge valve 171 so that the discharge valve 171 is closed.

A process in which the refrigerant flows into the compression space 103 through the suction valve 155 and the refrigerant in the compression space 103 through the discharge valve 171 is discharged to the discharge space 104 will be described as follows.

In the course of the piston 150 reciprocating linear movement inside the cylinder 140, when the pressure in the compression space 103 becomes a predetermined suction pressure or less, the refrigerant is suctioned to the compression space 103 while the suction valve 155 is opened. On the other hand, when the pressure in the compression space 103 exceeds a predetermined suction pressure, the refrigerant in the compression space 103 is compressed in a state where the suction valve 155 is closed.

Meanwhile, when the pressure in the compression space 103 is equal to or greater than a predetermined discharge pressure, the valve spring 172 opens the discharge valve 171 connected to the valve spring while the valve spring 172 deforms forward, and the refrigerant is discharged from the compression space 103 to the discharge space 104 of the discharge cover assembly 180. When the discharge of the refrigerant is completed, the valve spring 172 provides a restoring force to the discharge valve 171, and the discharge valve 171 is closed to seal the front of the compression space 103.

The discharge cover assembly 180 is installed in front of the compression space 103 to form a discharge space 104 to receive the refrigerant discharged from the compression space 103 and is coupled to the front of the frame 120 to attenuate noise generated in a process in which the refrigerant is discharged from the compression space 103. The discharge cover assembly 180 may be coupled to the front of the flange part 122 of the frame 120 while receiving the discharge valve assembly 170. For example, the discharge cover assembly 180 may be coupled to the flange part 122 through a mechanical coupling member.

Between the discharge cover assembly 180 and the frame 120, a gasket 165 for heat insulation and an O-ring 166 for suppressing leakage of the refrigerant in the discharge space 104 may be provided.

The discharge cover assembly 180 may be formed of a thermally conductive material. Accordingly, when a high-temperature refrigerant flows into the discharge cover assembly 180, the heat of the refrigerant may be transferred to the casing 110 through the discharge cover assembly 180 to radiate heat to the outside of the compressor.

The discharge cover assembly 180 may be formed of one discharge cover or may be disposed so that a plurality of discharge covers are sequentially communicated. When a plurality of discharge covers are provided, the discharge space 104 may include a plurality of space parts divided by each discharge cover. The plurality of space parts are disposed in the front and rear direction and communicate with each other.

For example, when there are three discharge covers, the discharge space 104 may include a first discharge space 103*a* formed between the first discharge cover 181 which is coupled to the front side of the frame 120 and the frame 120, a second discharge space 103*b* which communicates with the first discharge space 103*a* and formed between the second discharge cover 182 which is coupled to the front side of the first discharge cover 181 and the first discharge cover 181, and a third discharge space 103*c* which communicates with the second discharge space 103*b* and formed between the third discharge cover 183 which is coupled to the front side of the second discharge cover 182 and the second discharge cover 182.

The first discharge space 103*a* may selectively communicate with the compression space 103 by the discharge valve 171, the second discharge space 103*b* may communicate with the first discharge space 103*a*, and the third discharge space 103*c* may communicate with the second discharge space 103*b*. Accordingly, the refrigerant discharged from the compression space 103 passes through the first discharge space 103*a*, the second discharge space 103*b*, and the third discharge space 103*c* in sequence to reduce the discharge noise and may be discharged to the outside of the casing 110 through the loop pipe 115*a* and the discharge pipe 115, communicated to the third discharge cover 183.

The driving unit 130 may include an outer stator 131 disposed between the shell 111 and the frame 120 so as to surround the body part 121 of the frame 120, an inner stator 134 disposed between the outer stator 131 and the cylinder 140 so as to surround the cylinder 140, and a mover 135 disposed between the outer stator 131 and the inner stator 134.

The outer stator 131 may be coupled to the rear of the flange part 122 of the frame 120, and the inner stator 134 may be coupled to the outer circumferential surface of the body part 121 of the frame 120.

The inner stator 134 may be disposed to be spaced apart toward the inside of the outer stator 131, and the mover 135 may be disposed in a space between the outer stator 131 and the inner stator 134.

The outer stator 131 may be equipped with a winding coil, and the mover 135 may have a permanent magnet. The permanent magnet may be composed of a single magnet having one pole or may be composed of a combination of a plurality of magnets having three poles.

The outer stator 131 includes a coil winding body 132 surrounding the axial direction of the outer stator in the circumferential direction and a stator core 133 stacked while surrounding the coil winding body 132. The coil winding body 132 may include a hollow cylindrical bobbin 132*a* and a coil 132*b* wound in the circumferential direction of the bobbin 132*a*. The cross-section of the coil 132*b* may be formed in a circular or polygonal shape and, for example, may have a hexagonal shape. In the stator core 133, a plurality of lamination sheets may be radially stacked, and a plurality of lamination blocks may be stacked in a circumferential direction.

The front side of the outer stator 131 may be supported by the flange part 122 of the frame 120, and the rear side may be supported by the stator cover 137. For example, the stator cover 137 may be provided in the shape of a hollow disk, the outer stator 131 may be supported on the front surface, and the resonance spring 190 may be supported on the rear surface.

The inner stator 134 may be configured by stacking a plurality of laminations on the outer circumferential surface of the body part 121 of the frame 120 in the circumferential direction.

One side of the mover 135 may be coupled to and supported by the magnet frame 136. The magnet frame 136 has a substantially cylindrical shape and is disposed to be inserted into a space between the outer stator 131 and the inner stator 134.

The magnet frame 136 is coupled to the rear side of the piston 150 and is provided to move together with the piston 150.

For example, the rear end part of the magnet frame 136 may be bent and extended radially inward to form a coupling part 136*a*, and the coupling part 136*a* may be coupled to the flange part 153 formed at the rear of the piston 150. The coupling part 136*a* of the magnet frame 136 and the flange part 153 of the piston 150 may be coupled through a mechanical coupling member.

Further, a flange part 161*a* formed in front of the suction muffler 161 may be interposed between the flange part 153 of the piston 150 and the coupling part 136*a* of the magnet frame 136. Accordingly, the piston 150, the muffler unit 160, and the mover 135 can be linearly reciprocated together in a state where the piston 150, the muffler unit 160, and the mover 135 are integrally coupled.

When current is applied to the driving unit 130, a magnetic flux is formed in the winding coil, and the mover 135 may move by generating the electromagnetic force due to the interaction between the magnetic flux formed in the winding coil of the outer stator 131 and the magnetic flux formed by the permanent magnet of the mover 135. At the same time as the axial reciprocation movement of the mover 135, the piston 150 connected to the magnet frame 136 also reciprocates in the axial direction integrally with the mover 135.

Meanwhile, the driving unit 130 and the compression units 140 and 150 may be supported in the axial direction by the support springs 116 and 117 and the resonance spring 190.

The resonant spring 118 amplifies the vibration implemented by the reciprocating motion of the mover 135 and the piston 150, thereby effectively compressing the refrigerant. Specifically, the resonance spring 118 may be adjusted to a frequency corresponding to the natural frequency of the piston 150 so that the piston 150 can perform resonance motion. In addition, the resonance spring 118 may cause a stable movement of the piston 150 to reduce vibration and noise generation.

The resonance spring 118 may be a coil spring extending in the axial direction. Both end parts of the resonance spring 118 may be connected to the vibrating body and the fixing part, respectively. For example, one end part of the resonance spring 118 may be connected to the magnet frame 136 and the other end part thereof may be connected to the back cover 123. Accordingly, the resonance spring 118 may be elastically deformed between the vibrating body vibrating at one end part thereof and the fixing part fixed to the other end part.

The natural frequency of the resonance spring 118 is designed to match the resonance frequency of the mover 135 and the piston 150 when the compressor 100 is operated, so that the reciprocating motion of the piston 150 may be amplified. However, here, since the back cover 123 provided as a fixing part is elastically supported to the casing 110 through the first support spring 116, the fixing part may not be strictly fixed.

The resonance spring 118 may include a first resonance spring 118*a* supported on the rear side based on the spring supporter 119 and a second resonance spring 118*b* supported on the front side.

The spring supporter 119 may include a body part 119*a* surrounding the suction muffler 161, a coupling part 119*b* bent in an inner radial direction from the front of the body part 119*a*, and a support part 119*c* bent in an outer radial direction at the rear of the body part 119*a*.

The front surface of the coupling part 119*b* of the spring supporter 119 may be supported by the coupling part 136*a* of the magnet frame 136. The inner diameter of the coupling part 119*b* of the spring supporter 119 may be provided to surround the outer diameter of the suction muffler 161.

For example, the coupling part 119*b* of the spring supporter 119, the coupling part 136*a* of the magnet frame 136, and the flange part 153 of the piston 150 may be sequentially disposed and then integrally coupled through a mechanical member. At this time, as described above, the flange part 161*a* of the suction muffler 161 may be interposed between the flange part 153 of the piston 150 and the coupling part 136*a* of the magnet frame 136 to be fixed together.

The first resonance spring 118*a* may be provided between the front surface of the back cover 123 and the rear surface of the spring supporter 119, and the second resonance spring 118*b* may be provided between the rear surface of the stator cover 137 and the front surface of the spring supporter 119.

A plurality of first and second resonance springs 118*a* and 118*b* may be disposed in the circumferential direction of the central axis. The first resonance spring 118*a* and the second resonance spring 118*b* may be disposed parallel to each other in the axial direction or may be disposed alternately with each other. The first and second springs 118*a* and 118*b* may be disposed at regular intervals in the radial direction of the central axis. For example, three first and second springs 118*a* and 118*b* may be provided, respectively, and may be disposed at intervals of 120 degrees in the radial direction of the central axis.

Meanwhile, the compressor 100 may include a plurality of sealing members capable of increasing a coupling force between the frame 120 and parts around the frame 120.

For example, a plurality of sealing members may include a first sealing member interposed in a part where the frame 120 and the discharge cover assembly 180 are coupled and inserted into an installation groove provided at the front end part of the frame 120 and a second sealing member provided in a part in which the frame 120 and the cylinder 140 are coupled and inserted into an installation groove provided on the outer surface of the cylinder 140. The second sealing member prevents the refrigerant in the gas groove 125*c* formed between the inner circumferential surface of the frame 120 and the outer circumferential surface of the cylinder 140 from being leaked to the outside and can increase the coupling force between the frame 120 and the cylinder 140. The plurality of sealing members may further include a third sealing member provided at a part where the frame 120 and the inner stator 134 are coupled and inserted into an installation groove provided on an outer surface of the frame 120. Here, the first to third sealing members may have a ring shape.

The operation of the linear compressor 100 described above is as follows.

First, when a current is applied to the driving unit 130, magnetic flux may be formed in the outer stator 131 by the current flowing through the coil 132*b*. The magnetic flux formed in the outer stator 131 generates an electromagnetic force, and the mover 135 having a permanent magnet may linearly reciprocate by the generated electromagnetic force. This electromagnetic force may be generated in a direction (forward direction) in which the piston 150 is toward the top dead center (TDC) during the compression stroke and may be alternatively generated in a direction (rearward direction) in which the position 150 is toward the bottom dead center (BDC). In other words, the driving unit 130 may generate thrust which is a force which pushes the mover 135 and the piston 150 in the moving direction.

The piston 150 linearly reciprocating inside the cylinder 140 may increase and decrease the volume of the compression space 103 repeatedly.

When the piston 150 moves in a direction (rearward direction) which increases the volume of the compression space 103, the pressure in the compression space 103 decreases. Accordingly, the suction valve 155 mounted in front of the piston 150 is opened, and the refrigerant remaining in the suction space 102 can be suctioned into the compression space 103 along the suction port 154. This suction stroke proceeds until the piston 150 maximizes the volume of the compression space 103 and is located at the bottom dead center.

The piston 150 having reached the bottom dead center performs a compression stroke while moving in a direction (forward direction) in which the volume of the compression space 103 is reduced by changing the movement direction. During the compression stroke, the suctioned refrigerant is compressed as the pressure in the compression space 103 increases. When the pressure in the compression space 103 reaches the set pressure, the discharge valve 171 is pushed by the pressure in the compression space 103 and is opened from the cylinder 140, and the refrigerant is discharged to the discharge space 104 through the spaced space. This compression stroke continues while the piston 150 moves to the top dead center where the volume of the compression space 103 is minimum.

As the suction stroke and the compression stroke of the piston 150 are repeated, the refrigerant flowing into the receiving space 101 inside the compressor 100 through the suction pipe 114 flows into the suction space 102 inside the piston 150 via the suction guide 116*a*, the suction muffler 161, and the inner guide 162 in sequence, and the refrigerant in the suction space 102 flows into the compression space 103 inside the cylinder 140 during the suction stroke of the piston 150. During the compression stroke of the piston 150, the refrigerant in the compression space 103 is compressed and discharged to the discharge space 104, and then the flow discharged to the outside of the compressor 100 through the loop pipe 115*a* and the discharge pipe 115 can be formed.

Figure 3:
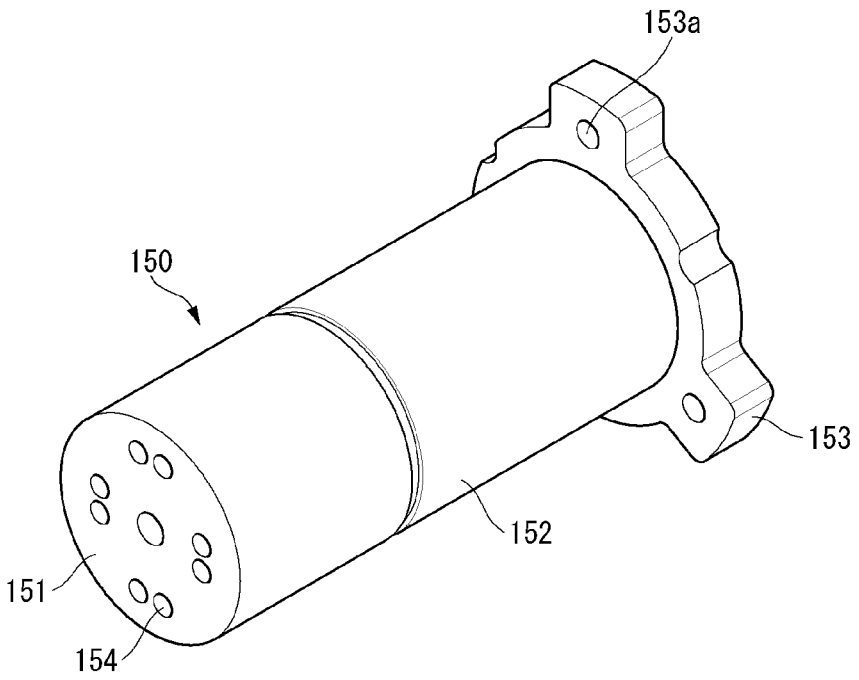
FIG. 3 is a perspective view illustrating a piston according to a comparative embodiment.
Figure 4:
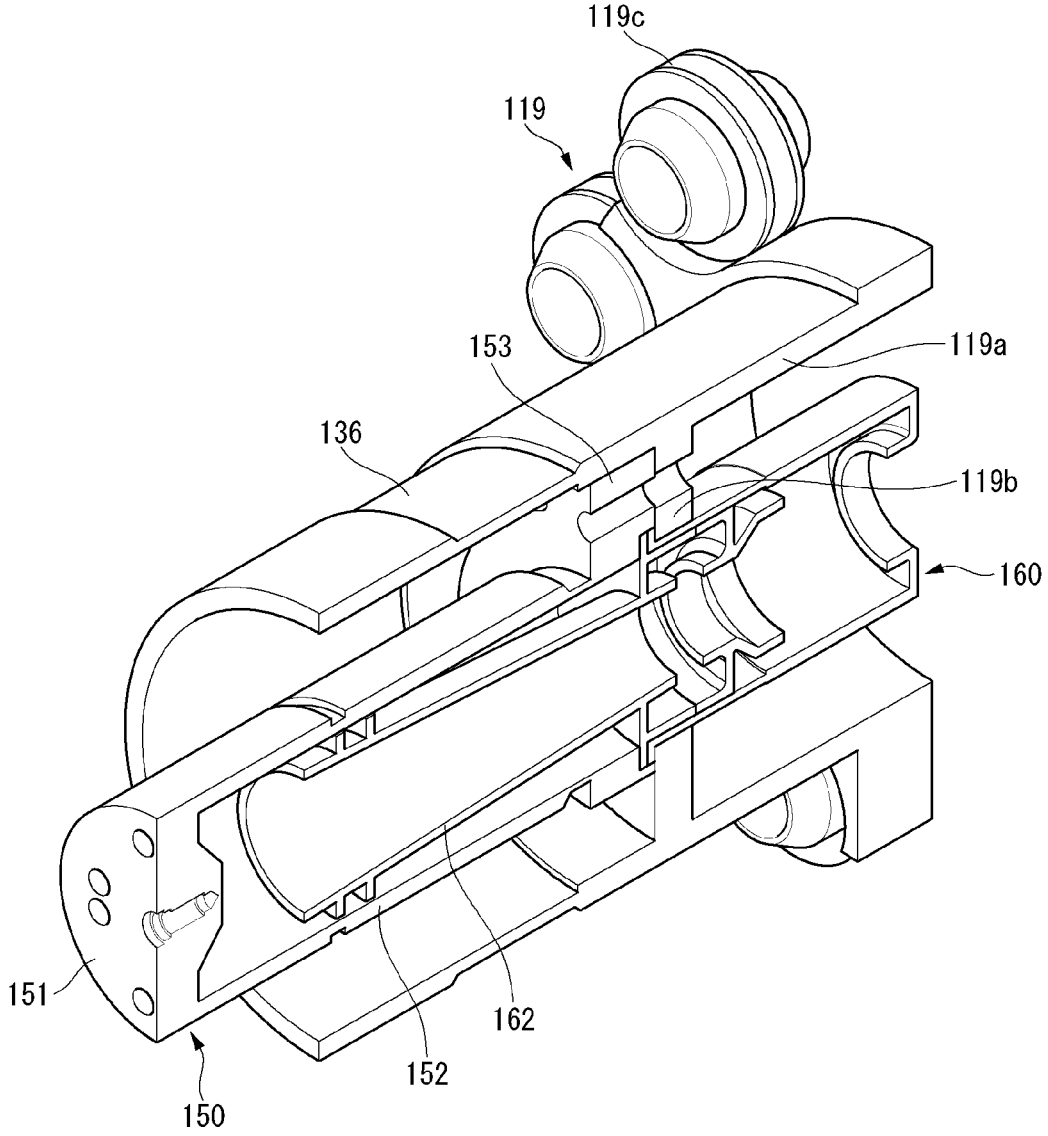
FIG. 4 is a perspective view illustrating the coupling state of the piston according to the comparative embodiment in cross-section.

FIG. 3 is a perspective view illustrating a piston 150 according to a comparative embodiment, and FIG. 4 is a perspective view illustrating a coupling state of the piston 150 of FIG. 3 in cross-section.

Referring to FIGS. 3 and 4, the piston 150 includes a head 151 which is located in the front thereof and which divides the compression space 103 (see FIG. 1), a guide 152 having a cylindrical shape extending from the outer circumferential surface of the head 151 to the rear, and a flange part 153 extending outward in the radial direction from the rear of the guide 152 to fix the piston 150 to the compressor structure.

A suction port 154 is formed to pass through the head 151 of the piston 150. The suction port 154 is provided to communicate the suction space 102 (see FIG. 1) and the compression space 103 inside the piston 150.

The flange part 153 of the piston 150 is coupled to the magnet frame 136 (see FIG. 1) and formed with a coupling hole 153*a* through which the fastening member passes to be coupled to the coupling part 136*a* (see FIG. 1) of the magnet frame 136 through a fastening member.

The piston 150 according to this comparative embodiment has no fluidity when the piston 150 is mechanically coupled directly to the magnet frame 136 and moves in the forward and backward directions. Accordingly, when an error occurs in the alignment of the piston 150, contact occurs between the piston 150 and the cylinder 140.

Figure 5:
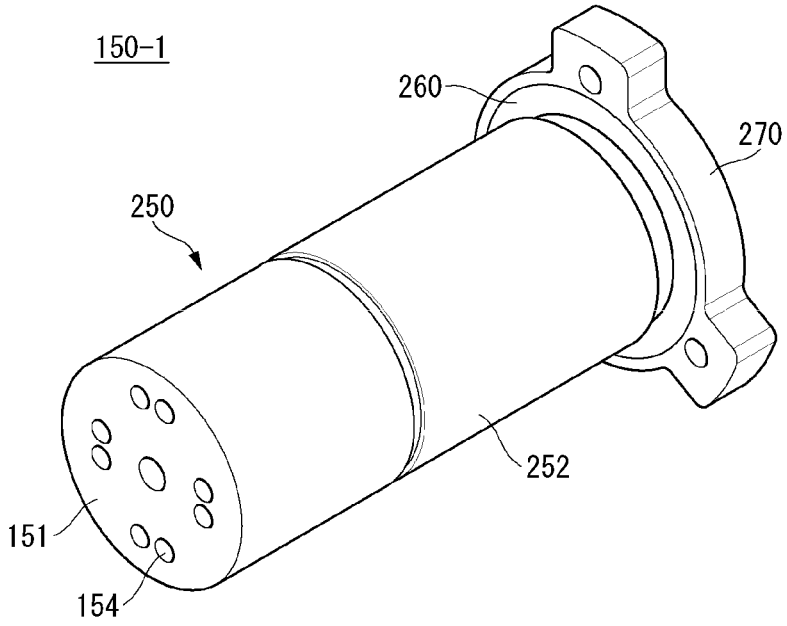
FIG. 5 is a perspective view illustrating a piston according to a first embodiment.
Figure 6:
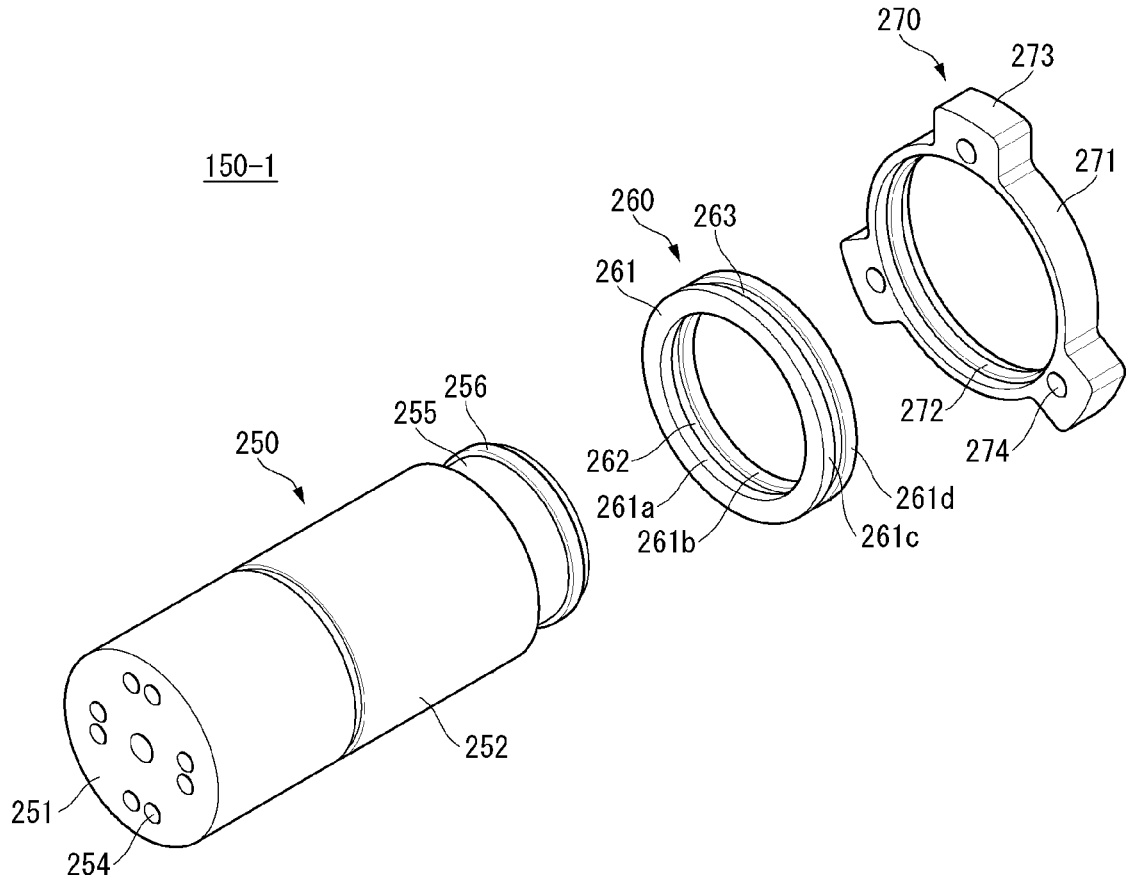
FIG. 6 is an exploded perspective view of FIG. 5.

FIG. 5 is a perspective view illustrating a piston 150-1 according to the first embodiment, and FIG. 6 is an exploded perspective view of FIG. 5.

Referring to FIGS. 5 and 6, the piston 150-1 according to the first embodiment may include a guide member 250 reciprocating the inside of the cylinder 140 in the axial direction, a bushing member 260 coupled to the guide member 250, and a mount member 270 coupled to the bushing member 260.

The guide member 250 may include a head 251 located in the front and dividing the compression space 103 (see FIG. 1), and a guide 252 having a cylindrical shape and extending rearward from the outer circumferential surface of the head 251.

The bushing member 260 may be coupled to an outer circumferential surface of the rear end part of the guide member 250, and the mount member 270 may be coupled to an outer circumferential surface of the bushing member 260.

In the guide member 250, the head 251 and the guide 252 are provided as separate members and are coupled to each other, or the head 251 and the guide 252 are integrally formed.

An extension part 255 to which the bushing member 260 can be coupled is provided at the rear end part of the guide member 250.

For example, the extension part 255 may be bent at the rear end part of the guide 252 to have a smaller radius to form a step and extend rearward. Since the radius of the extension part 255 is provided smaller than the radius of the guide 252, and thus it is possible to compensate for an increase in the volume of the piston 150-1 which increases by the thickness of the bushing member 260.

In addition, the extension part 255 may extend to the same radius as the guide 252 to facilitate manufacturing, or have a radius larger than the radius of the guide 252 to increase the rigidity of the coupling part.

The guide member 250 may further include a first coupling part 256 for coupling with the bushing member 260.

The first coupling part 256 may be provided in the shape of a protrusion. In this case, the first coupling part 256 may be defined as a first coupling protrusion.

The first coupling part 256 is provided to protrude from the outer circumferential surface of the extension part 255, so that the coupling with the bushing member 260 may be secured. For example, the first coupling part 256 may protrude in a ring shape from the outer circumferential surface of the extension part 255.

Meanwhile, the first coupling part 256 may be provided in the shape of a groove. At this time, the bushing member 260 may be formed with a protrusion coupled to the first coupling part 256 provided in the shape of a groove.

Hereinafter, the first coupling part 256 will be described as a first coupling protrusion in the shape of a protrusion.

The bushing member 260 is interposed between the guide member 250 and the flange member 270 and may mediate the coupling between the flange member 270 and the guide member 250.

The bushing member 260 may be made of an elastic material. In other words, the bushing member 260 may be defined as an elastic member 260.

For example, the bushing member 260 may be made of a rubber material and be made of a rubber material with shore hardness of or more in order to prevent the piston 150-1 from being displaced in the longitudinal direction or the guide member 250 from being separated.

The bushing member 260 may function as a self-aligning device capable of correcting the alignment of the guide member 250.

The bushing member 260 may be provided to have elasticity in the radial direction. In other words, it is possible to receive the tilting of the guide member 250 to some extent.

Therefore, when the guide member 250 receives a force in the radial direction during the forward and backward movement, the guide member 250 can be prevented from colliding with the cylinder 140 while the bushing member 260 is transformed in the radial direction to absorb the force.

The bushing member 260 may be provided to have elasticity in the circumferential direction. In other words, the bushing member 260 can receive the rotation of the guide member 250 to some extent.

Therefore, when the guide member 250 receives torque in the circumferential direction during the forward and backward movement, the bushing member 260 is deformed in the twisting direction to absorb the torque, and the fatigue applied to the guide member 250 can be alleviated.

The bushing member 260 may include a circular ring-shaped body 261, an inner coupling part formed on the inner circumferential surface of the body 261, and an outer coupling part formed on the outer circumferential surface of the body 261.

Figure 7:
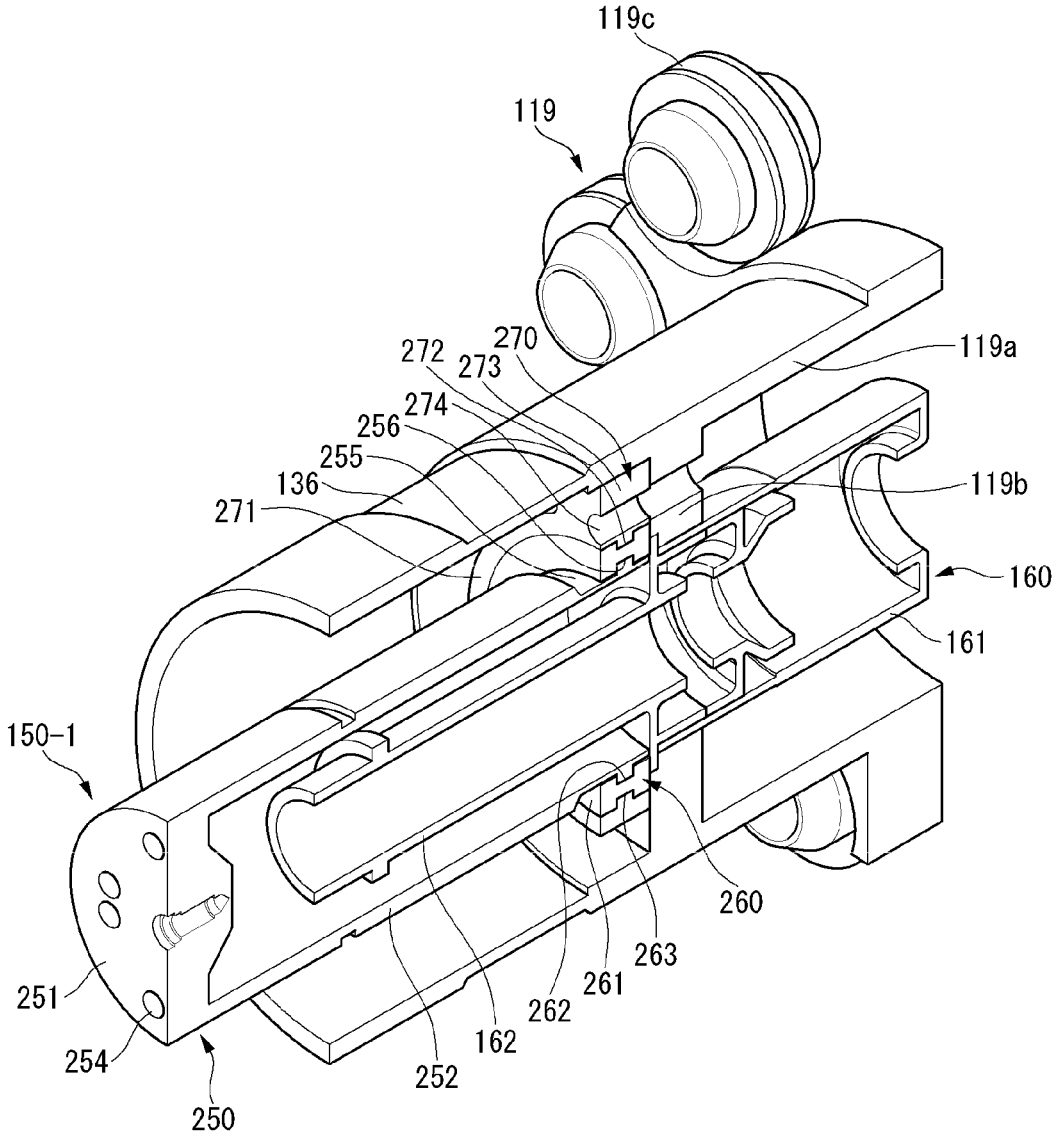
FIG. 7 is a perspective view illustrating the coupling state of the piston according to the first embodiment in cross-section.
Figure 8:
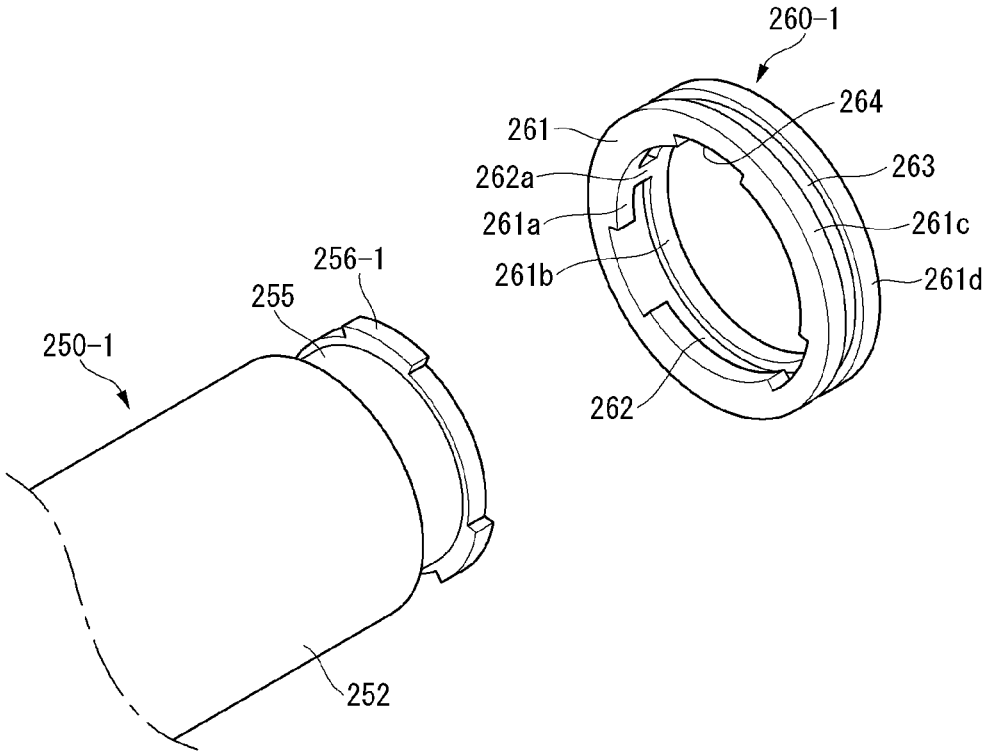
FIG. 8 is an enlarged view illustrating a coupling state of a bushing member as a modified embodiment of the first embodiment.

Referring to FIGS. 6 to 8, as an embodiment, the inner coupling part may include an inner coupling groove 262 recessed into the inner circumferential surface of the body 261, and the outer coupling part may include an outer coupling groove 263 recessed into the outer circumferential surface of the body 261.

The bushing member 260 may be provided with inner locking jaws 261*a* and 261*b* which are located on the inner circumferential surface of the body 261 and protrude inward from the inner coupling groove 262 in the radial direction.

In detail, a ring-shaped first inner locking jaw 261*a* protruding inward in the radial direction is formed on one side (front) of the inner coupling groove 262, and a ring-shaped second inner locking jaw 261*b* protruding inward in the radial direction is formed on the other side (rear) thereof.

When the first coupling part 256 is provided in the form of a protrusion, the first coupling part 256 is prevented from being separated to the front by the first inner locking jaw 261*a* and prevented from being separated to the rear by the second inner locking jaw 261*b*.

The bushing member 260 may be provided with outer locking jaws 263*a* and 263*b* which are located on the outer circumferential surface of the body 261 and protrude outward from the outer coupling groove 263 in the radial direction.

A ring-shaped first outer locking jaw 261*c* protruding outward in the radial direction is formed on one side (front) of the outer coupling groove 263, and a ring-shaped second outer locking jaw 261*d* protruding outward in the radial direction is formed on the other side (rear) thereof.

When a second coupling part 272 to be described later is provided in the form of a protrusion, the second coupling part is prevented from being separated to the front by the first outer locking jaw 261*c* and is prevented from being separated to the rear by the second outer locking jaw 261*d*.

The inner coupling groove 262 has a shape corresponding to the first coupling part 256 so that the first coupling part 256 protruding from the outer circumferential surface of the extension part 255 of the guide member 250 can be inserted thereinto.

As the first coupling part 256 is inserted into the inner coupling groove 262, it is possible to prevent the guide member 250 from being separated from the bushing member 260. In addition, the assembly convenience may be improved through the coupling of the first coupling protrusion 256 and the inner coupling groove 262 in the assembly process.

In addition, the width (length and width in the axial direction) of the outer coupling groove 263 may be formed to have a value of 1.5 or more of the depth (length in the radial direction) of the outer coupling groove 263.

In addition, the width (length and width in the axial direction) of the inner coupling groove 262 may be formed to have a value of 1.5 or more of the depth (length in the radial direction) of the inner coupling groove 262.

Meanwhile, in the first coupling protrusion 256 and the inner coupling groove 262 coupled thereto, the positions of the groove and the protrusion may be changed. For example, a groove may be formed on the outer circumferential surface of the coupling part 256 of the guide member 250, and a protrusion may be formed on the inner circumferential surface of the bushing member 260.

The outer coupling groove 263 may have a shape corresponding to the second coupling part 272 so that the second coupling part 272 formed on the inner circumferential surface of the body 271 of the mount member 270 can be inserted.

In other words, when the outer coupling groove 263 may be formed in the bushing member 260, the mount member 270 has a second coupling part 272 in the form of a protrusion protruding from the inner circumferential surface of the body 271. In this case, the second coupling part 272 may be defined as a second coupling protrusion.

As the second coupling part 272 is inserted into the outer coupling groove 263, it is possible to prevent the bushing member 260 from being separated from the mount member 270. In addition, even in the assembly process, assembly convenience may be improved through the coupling of the second coupling part 272 and the outer coupling groove 263.

The inner coupling groove 262 and the outer coupling groove 263 may be processed to have a groove depth of about 2 mm and may allow a tolerance of 0.1 mm. The ratio of the size of the width of the protrusion to the length of the protrusion is designed to be 1.5 or more so that it is possible to prevent shaking and separation in the longitudinal direction (axial direction).

Meanwhile, in the second coupling part 272 and the outer coupling groove 263 coupled thereto, the positions of the grooves and the protrusions may be changed. For example, a groove may be formed on an inner circumferential surface of the body 271 of the mount member 270 and a protrusion may be formed on the outer circumferential surface of the bushing member 260.

The mount member 270 may include a ring-shaped body 271 surrounding the bushing member 260, a mount flange 273 which protrudes from the outer circumferential surface of the body 271 and fixes the mount member 270 to the compressor structure, and a second coupling part 272 formed on the inner circumferential surface of the body 271.

The second coupling part 272 may be formed to correspond to the shape of the outer coupling part of the bushing member 260. In detail, when the outer coupling part of the bushing member 260 is provided in the form of a protrusion or a groove, the second coupling part 272 may be provided in the form of a groove or a protrusion.

A plurality of mount flanges 273 may be formed on the outer circumferential surface of the body 271 and may be disposed at the same angle. For example, three mount flanges 273 may be formed at intervals of 120 degrees.

A mounting hole 274 through which a fastening member is coupled may be formed on the mount flange 273.

The mount flange 273 may be coupled to a magnet frame 136 (see FIG. 1) or a spring supporter 119 (see FIG. 1). For example, a fastening member passing through the mount hole 274 may be coupled to the magnet frame 136 or the spring supporter 119 to fix the flange member 270. In the mount member 270 according to the first embodiment, the mount flange 273 may be defined as a frame coupling part coupled to the magnet frame 136.

Meanwhile, in the present discloser, the magnet frame 136 may be integrally formed with the spring supporter 119, and the magnet frame 136 may be understood as a concept including the spring supporter 119. In addition, it is natural that the meaning that the flange member 270 is coupled to the spring supporter 119 may be interpreted as the meaning that the flange member 270 is connected to the magnet frame 136.

FIG. 7 is a perspective view illustrating a coupling state of the piston 150-1 according to the first embodiment in cross-section.

Referring to FIG. 7, the guide member 250 may be coupled to the spring supporter 119 through the flange member 270.

The bushing member 260 may be interposed between the guide member 250 and the mount member 270 to allow the guide member 250 to move with respect to the mount member 270 by a predetermined displacement.

Meanwhile, unlike the drawings, the mount member 270 may be coupled to the magnet frame 136. Alternatively, the magnet frame 136 and the spring supporter 119 may be integrally formed, and the mount member 270 may be coupled to the magnet frame 136 or the spring supporter 119 formed integrally.

The bushing member 260 may allow displacement of the guide member 250 in the axial direction and also allow displacement of the guide member 250 in the circumferential direction.

In other words, the bushing member 260 is deformed by transmitting contact pressure, the pressure of the lubrication surface, which is applied to the guide member, or the like, and the posture of the piston 150-1 becomes variable due to the deformation of the bushing member 26. As such, by securing the degree of freedom of the guide member 250, the alignment of the guide member 250 can be satisfied with only the pressure generated on the lubrication surface between the piston 150-1 and the cylinder 140, and the reliability and durability can be improved by minimizing the contact pressure. Accordingly, the piston 150-1 can operate stably while minimizing misalignment in the cylinder 140.

In addition, in the case of the linear compressor 100 operating without a separate sensor, there is a possibility that the head 251 intermittently collides with the discharge valve 171, and at this time, the bushing member 260 may act as a buffer to absorb impact.

In addition, when compared with other self-aligning devices made of metal, the bushing member 260 does not require a separate lubricant and has a low possibility of a loss of function due to fatigue failure, so the bushing member is excellent in durability and management aspects.

FIG. 8 is a view illustrating an enlarged view of a coupling state of the bushing member 260-1, as a modified embodiment of the first embodiment.

The first coupling part 256-1 of the guide member 250-1 is coupled to the inner coupling part of the bushing member 260-1, and the second coupling part 272 of the mount member 270 may be coupled to the outer coupling part of the bushing member 260-1.

Referring to FIG. 8, an inner coupling groove 262 is formed on the inner circumferential surface of the bushing member 260-1, so that the first coupling part 256-1 of the guide member 250-1 in the form of a protrusion is coupled to the inner coupling groove 262, and an outer coupling groove 263 is formed on the outer circumferential surface of the bushing member 260-1 so that the second coupling part 272 of the mount member 270 in the form of a protrusion is coupled to the outer coupling groove 263.

As, the body 261 of the bushing member 260-1, which is made of a deformable material having elasticity, can be deformed from a circular shape to an oval shape to some extent, it is not difficult to couple any one member inside or outside the body of the bushing member. However, since the body 261 of the bushing member 260-1 maintains a circular shape after coupling one member to the inside or outside the body of the bushing member, in order to couple the other member to the opposite side of the inside or outside the body of the bushing member, a portion of the front or rear ring-shaped body 261 (locking jaw) of the coupling groove has to be deformed to allow the entry of a protrusion having an outer diameter larger than the inner diameter of the body 261. However, if a part (locking jaw) of the body 261 is allowed to be deformed in this way, there is a possibility that the guide member 250-1 is separated from the bushing member 260-1 or the bushing member 260-1 is separated from the mount member 270 during operation of the compressor 100.

To prevent this, the first coupling part 256-1 of the guide member 250-1 is provided in a protrusion shape which protrudes at regular intervals in the circumferential direction rather than a ring shape, and the bushing member 260-1 may form a sliding passage 264 corresponding to the shape of the first coupling part 256-1 on the first inner locking jaw 261*a*.

In this case, the sliding passage 264 formed on the inner circumferential surface of the bushing member 260-1 may be defined as an inner sliding passage.

For example, when three first coupling parts 256-1 are formed at intervals of 120 degrees, three sliding passages 264 corresponding to the first coupling parts are also formed at intervals of 120 degrees.

The coupling method of the piston 150-1 is as follows. First, the bushing member 260-1 is coupled to the mount member 270. At this time, since the bushing member 260-1 may be deformed, the second coupling part 272 can be easily coupled to the outer coupling groove 263 despite the outer locking jaws 261*c* and 261*d*. Next, at the position in which the first coupling part 256-1 of the guide member 250-1 and the sliding passage 264 of the bushing member 260-1 correspond to each other, the first coupling part 256-1 passes through the opening of the sliding passage 264 to coupled to the inner coupling groove 262. Thereafter, the guide member 250-1 is rotated by a predetermined angle so that the first coupling parts 256-1 are alternately disposed in the sliding passage 264.

Meanwhile, a stopper 262*a* for preventing rotation of the first coupling part 256-1 may be formed in the inner coupling groove 262.

In this case, the stopper 262*a* formed in the inner coupling groove 262 may be defined as an inner stopper.

The stopper 262*a* is provided to protrude inward the inner coupling groove 262 in the radial direction, and the stopper can prevent the first coupling part 256-1 from rotating to the position in which the sliding passage 264 adjacent to the sliding passage 264 through which the first coupling part 256-1 has passed is located. For example, the stopper 262*a* may be formed to protrude at an intermediate angle of the adjacent sliding passage 264.

Meanwhile, the groove, the sliding passage, and the stopper of the bushing member 260-1 may be formed by changing positions with protrusions of the guide member 250-1. In other words, a protrusion is formed on the inner circumferential surface of the bushing member 260-1, and the groove into which the protrusion is inserted, the sliding passage through which the protrusion passes, and the stopper which prevents the rotation of the protrusion over a certain angle or more are prevented can be formed on the guide member 250-1.

Figure 9:
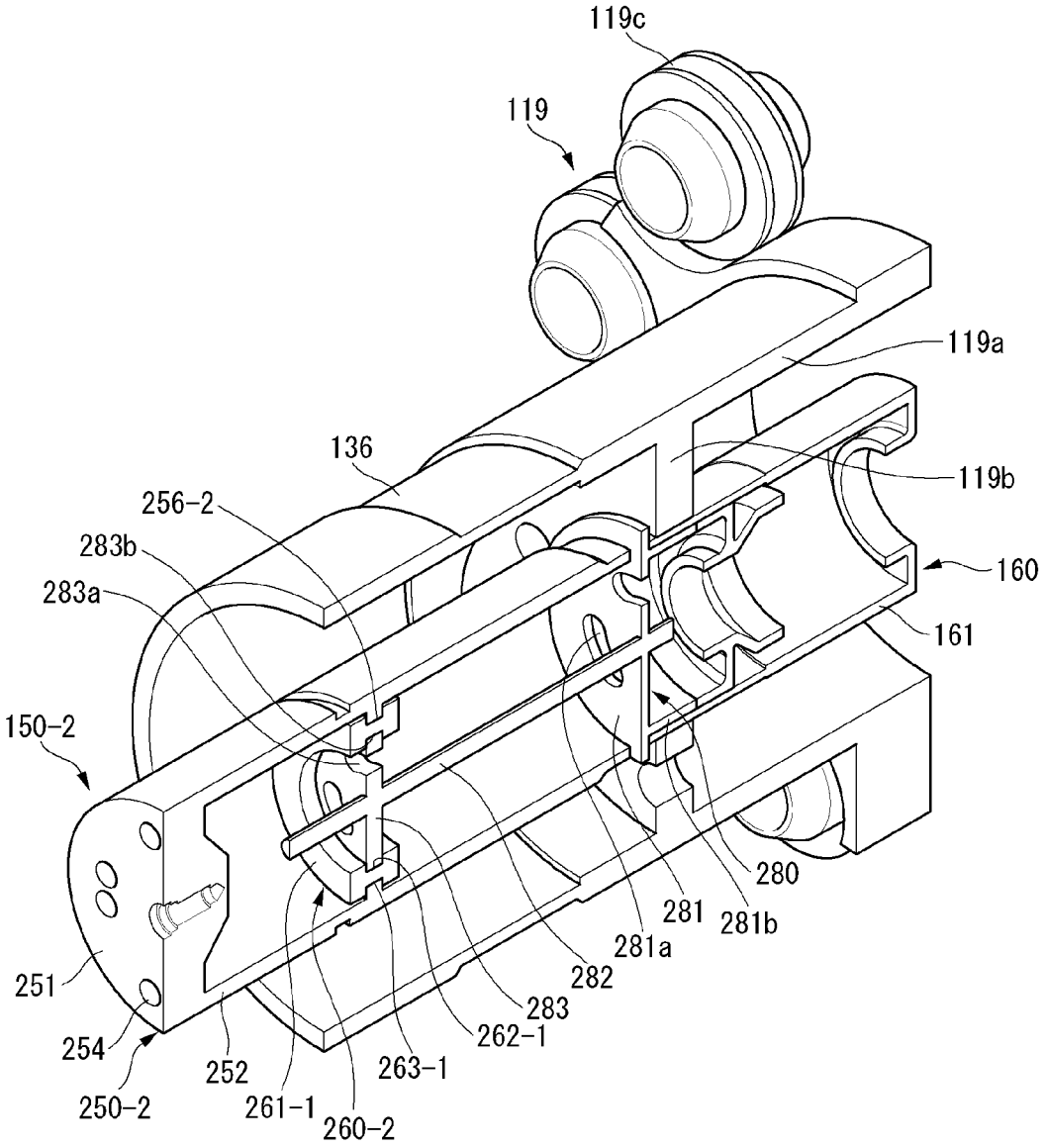
FIG. 9 is a perspective view illustrating a coupling state of a piston according to a second embodiment in cross-section.

FIG. 9 is a perspective view illustrating the coupling state of the piston 150-2 according to the second embodiment in cross-section.

Referring to FIG. 9, the guide member 250-2 may be coupled to the spring supporter 119 through the mount member 280. The bushing member 260-2 may be interposed between the guide member 250-2 and the mount member 280 to allow the guide member 250-2 to move by a predetermined displacement relative to the mount member 280.

Meanwhile, unlike the drawings, the mount member 280 may be coupled to the magnet frame 136. Alternatively, the magnet frame 136 and the spring supporter 119 may be integrally formed, and the mount member 280 may be coupled to the magnet frame 136 or the spring supporter 119 formed integrally.

The mount member 280 may include a support plate 281 coupled to the spring supporter 119 or the magnet frame 136, and a mount member extension part extending forward from the support plate 281.

The mount member extension part may include a mount bar 282 which extends forward from one surface of the support plate 281, and a coupling plate 283 which extends outward from a front portion of the mount bar 282 in the radial direction and to which a bushing member 260 is coupled.

The support plate 281 may be provided in a circular plate shape.

The outer circumferential part of the support plate 281 may be coupled to the spring supporter 119. For example, a coupling part 281*b* having a cylindrical shape may extend at the rear of the support plate 281, and the coupling part 281*b* of the support plate 281 can be inserted and fitted into the coupling part 119*b* of the spring supporter 119. In other words, the coupling part 119*b* of the spring supporter 119 may support two or more points of the outer circumferential surface of the coupling part 281*b* of the support plate 281.

Meanwhile, the support plate 281 may be coupled to the spring supporter 119 or the magnet frame 136 together with the muffler unit 160. For example, the coupling part 281*b* of the support plate 281 may be inserted and fitted into the front opening of the muffler unit 160, and the front portion of the muffler unit 160 can be inserted and fitted into the coupling part 119*b* of the spring supporter 119.

The support plate 281 may have a communication hole 281*a* through which the refrigerant flowing from the muffler unit 160 passes. For example, the communication holes 281*a* may be formed as circular or arc-shaped openings, and a plurality of communication holes 281*a* may be formed in the circumferential direction of the support plate 281.

The mount bar 282 may have a shape of a bar extending in the front axis direction of the support plate 281. For example, the mount bar 282 may extend forward from the center of the support plate 281 along the center of the guide member 250-2 but may extend to be spaced apart from the head 251.

In other words, the mount bar 282 may be prevented from contacting the head 251.

The coupling plate 283 may have a disk shape coupled to the front outer circumferential surface of the mount bar 282.

The mount member 280 may further include a second coupling part coupled to the bushing member 260-2. The second coupling part according to the second embodiment of the present discloser differs from the second coupling part of the first embodiment in position and coupling relationship thereof.

The second coupling part may be provided on the coupling plate 283. The second coupling part may be formed in a shape corresponding to the inner coupling part formed on the inner circumferential surface of the bushing member 260-2.

As an example, the second coupling part may be an outer circumferential edge 283*b* of the coupling plate 283 inserted into and coupled to the inner coupling groove 262-1 of the bushing member 260-2.

A communication hole 283*a* through which the refrigerant flowing from the muffler unit 160 may pass may be formed on the coupling plate 283. For example, the communication holes 283*a* may be formed as circular or arc-shaped openings, and a plurality of communication holes 283*a* may be formed in the circumferential direction of the coupling plate 283.

The bushing member 260-2 according to the second embodiment may be located inside the guide member 250-2 and may be disposed to surround the mount member 280.

The guide member 250-2 according to the second embodiment differs from the first embodiment in a position coupled to the bushing member 260-2. In detail, the first coupling part 256-2 according to the second embodiment is formed on the inner circumferential surface of the guide member 250-2 and may be coupled to the bushing member 260-2.

The bushing member 260-2 may include a ring-shaped body 261-1, an outer coupling part formed on the outer circumferential surface of the body 261-1, and an inner coupling part formed on the inner circumferential surface of the body 261-1.

The body 261-1 may be disposed to surround the coupling plate 283 of the mount member 280.

In addition, the outer coupling part is coupled to the first coupling part 256-2 formed on the inner circumferential surface of the guide member 250-2, and the inner coupling part can be coupled to a coupling plate 283 of the mount member 280.

Referring to FIG. 9, the outer coupling part may include an outer coupling groove 263-1 coupled to the first coupling part 256-2 in the form of a protrusion formed on the inner circumferential surface of the guide member 250-2 and the inner coupling part may include an inner coupling groove 262-1 coupled to the outer circumferential edge of the coupling plate 283.

Meanwhile, the outer coupling groove 263-1 of the bushing member 260-2 and the shapes of the protrusions of the first coupling part 256-2 of the guide member 250-2 may change positions with each other. In other words, the bushing member 260-2 may have a protrusion-shaped outer coupling part, and a groove into which the protrusion is inserted may be formed on an inner circumferential surface of the guide member 250-2.

The bushing member 260-2 may be located at or in front of the central part of the guide member 250-2. In other words, the first coupling part 256-2 formed on the inner circumferential surface of the guide member 250-2 may be located at or in front of the central part of the guide member 250-2.

The rear end part of the guide member 250-2 is disposed to be spaced apart from the support plate 281 in the axial direction. Accordingly, when the bushing member 260-2 is elastically deformed by the force applied to the guide member 250-2, it is possible to prevent the guide member 250-2 from colliding with the support plate 281.

However, the gap between the guide member 250-2 and the support plate 281 may be minimized only to allow the relative displacement of the guide member 250-2. The diameter of the support plate 281 may be equal to or larger than the diameter of the guide member 250-2.

The bushing member 260-2 may allow displacement of the guide member 250-2 in the axial direction and also allow displacement of the guide member 250-2 in the circumferential direction. In other words, the bushing member 260-2 is deformed by transmitting contact pressure, the pressure of the lubrication surface, applied to the guide member 250-2, or the like and the posture of the piston 150-2 is variably deformed by the deformation of the bushing member 260-2. As such, by securing the degree of freedom of the guide member 250-2, the alignment of the guide member 250-2 can be satisfied with only the pressure generated on the lubrication surface between the piston 150-2 and the cylinder 140, and reliability and durability can be improved by minimizing the contact pressure. Therefore, the piston 150-2 can operate stably while minimizing misalignment in the cylinder 140.

Figure 10:
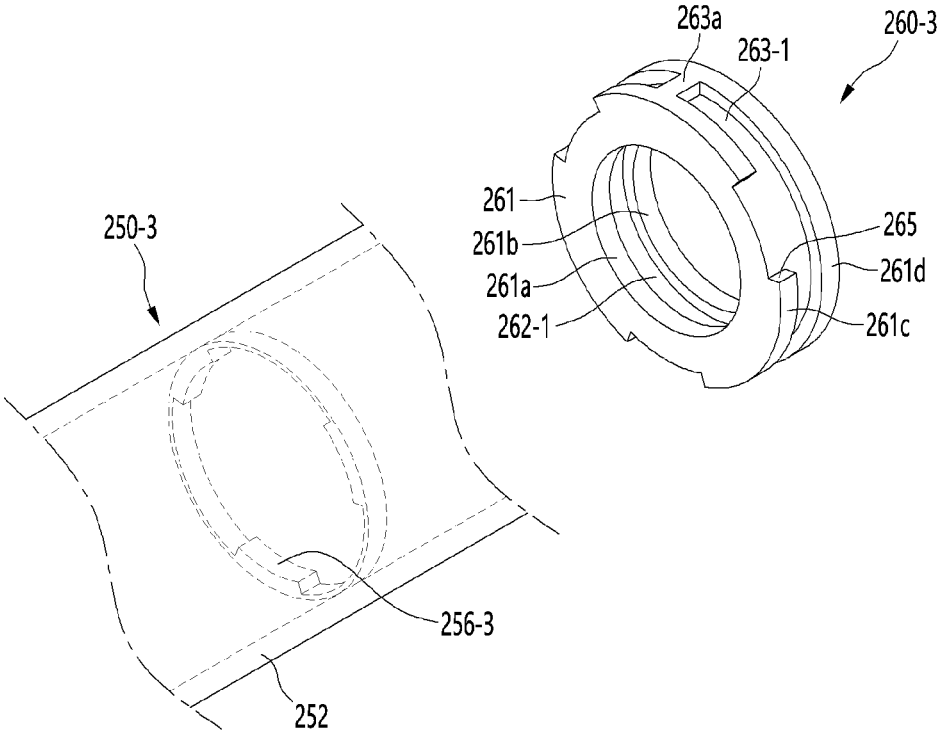
FIG. 10 is an enlarged view illustrating a coupling state of a bushing member as a modified embodiment of the second embodiment.

FIG. 10 is an enlarged view illustrating a coupling state of the bushing member 260-3 as a modified embodiment of the second embodiment.

In the bushing member 260-3, the outer circumferential edge of the coupling plate (283) is coupled to the inner coupling groove 262-1 of the inner circumferential surface, and the first coupling part 256-3 of the guide member 250-3 in the form of a protrusion is coupled to the outer coupling groove 263-1 of the outer circumferential surface.

The first coupling part 256-3 according to the modified embodiment of the second embodiment of the present discloser has a difference in shape from the first coupling part 256-2 of the second embodiment.

A body 261-1 Of the bushing member 260-3, which is made of a deformable material having elasticity, can be deformed from a circular shape to an oval shape to some extent so that it is not difficult that any one member is coupled to the inside or outside the body 261-1 Of the bushing member 260-3. However, after coupling one member to the inside or outside the body 261-1 Of the bushing member 260-3, since the body 261-1 of the bushing member 260-3 maintains a circular shape, in order to couple the other member to the opposite side of the inside or outside the body 261-1 Of the bushing member 260-3, a part(locking jaw) of the ring-shaped body 261-1 at the front or rear of the coupling groove has to be deformed so as to allow the entry of a protrusion having an outer diameter larger than the inner diameter of the body 261-1. However, if a part (locking jaw) of the body 261-1 is allowed to be deformed in this way, there is a possibility that the guide member 250-3 is separated from the bushing member 260-3 or the bushing member 260 is separated from the mount member 280 during the operation of the compressor 100.

To prevent this, the first coupling part 256-3 of the guide member 250-3 is provided in a protrusion shape which protrudes at regular intervals in the circumferential direction rather than a ring shape, and the bushing member 260-3 may form a sliding passage 265 corresponding to the shape of the first coupling part 256-3 on the first outer locking jaw 261*c*.

In this case, the sliding passage 265 formed on the outer circumferential surface of the bushing member 260-3 may be defined as an outer sliding passage.

For example, when the first coupling part 256-3 is formed of three protrusions spaced apart at intervals of 120 degrees, three sliding passages 265 corresponding to the three protrusions are also spaced at intervals of 120 degrees.

The coupling method of the piston 150-2 is as follows. First, the bushing member 260-3 is coupled to the mount member 280. At this time, since the bushing member 260-3 may be deformed, the edge of the coupling plate 283 can be easily coupled to the inner coupling groove 262-1 despite the inner locking jaws 261*a* and 261*b*. Next, at the position in which the first coupling part 256-3 of the guide member 250-3 and the sliding passage 265 of the bushing member 260-3 correspond to each other, the first coupling part 256-3 passes through the opening of the sliding passage 265 and thus coupled to the outer coupling groove 263-1. Thereafter, the guide member 250-3 is rotated by a predetermined angle so that the first coupling parts 256-3 are alternately disposed in the sliding passage 265.

Meanwhile, a stopper 263*a* which prevents rotation of the first coupling part 256-3 may be formed in the outer coupling groove 263-1. In this case, the stopper 263*a* formed in the outer coupling groove 263-1 may be defined as an outer stopper.

The stopper 263*a* is provided to protrude outward the outer coupling groove 263-1 in the radial direction, and the stopper 263*a* can prevent the first coupling part 256-3 from rotating to the position in which the sliding passage 265 adjacent to the sliding passage 265 through which the first coupling part 256-3 has passed is located. For example, the stopper 263*a* may be formed to protrude at an intermediate angle of the adjacent sliding passage 265.

Meanwhile, the groove, the sliding passage, and the stopper of the bushing member 260-3 may be formed by changing positions with the protrusion of the guide member 250-3. In other words, a protrusion is formed on the outer circumferential surface of the bushing member 260-3, and the groove into which the protrusion is inserted, the sliding passage through which the protrusion passes, and the stopper which prevent rotation of the protrusion over a certain angle or more are prevented may be formed on the guide member 250-3.

Figure 11:
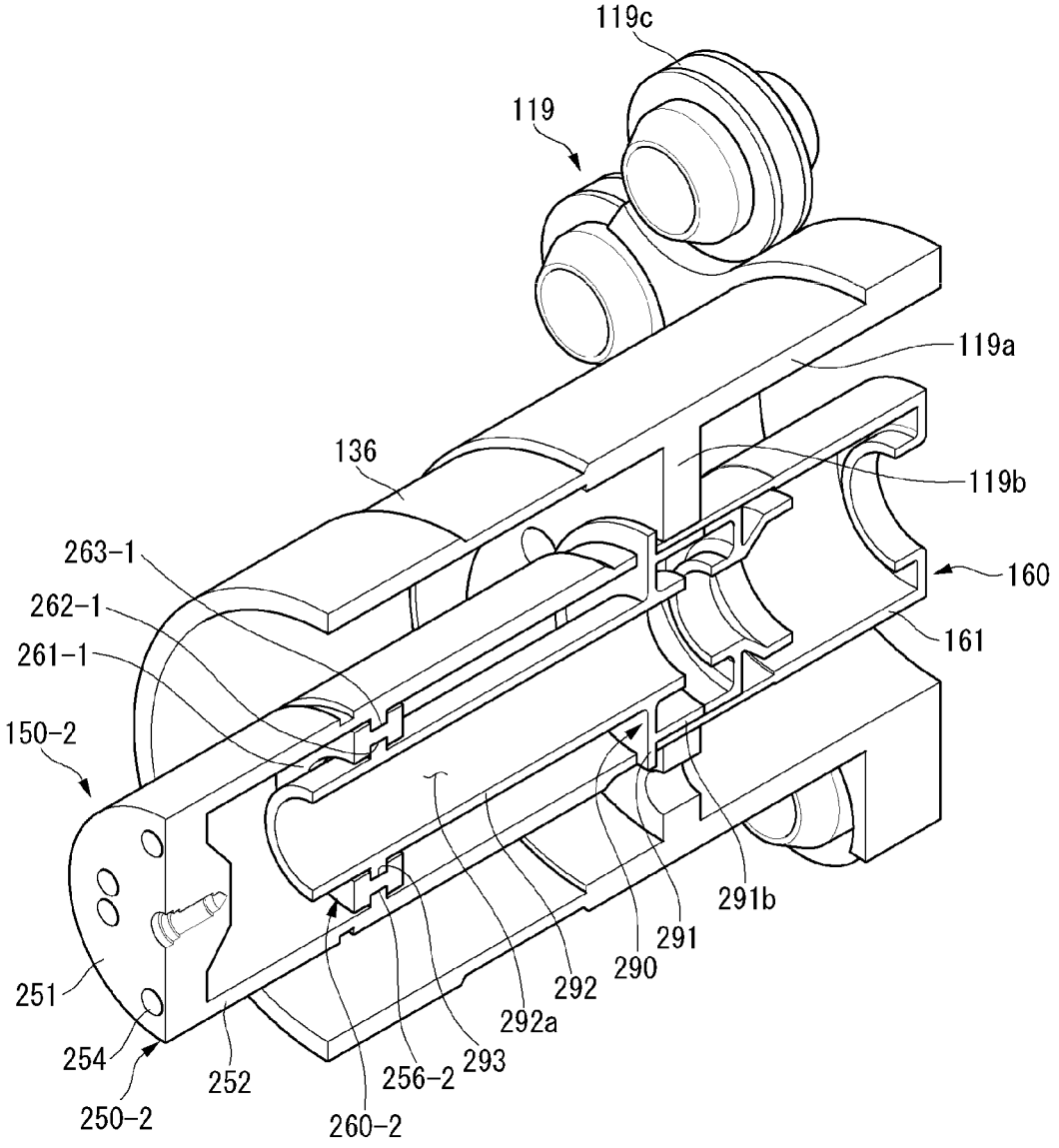
FIG. 11 is a perspective view illustrating a coupling state of a piston according to a third embodiment in cross-section.

FIG. 11 is a perspective view illustrating a coupling state of the piston 150-2 according to the third embodiment in cross-section.

Referring to FIG. 11, the guide member 250-2 may be coupled to the spring supporter 119 through the mount member 290. The bushing member 260-2 may be interposed between the guide member 250-2 and the mount member 290 to allow the guide member 250-2 to move by a predetermined displacement relative to the mount member 290.

Meanwhile, unlike the drawings, the mount member 290 may be coupled to the magnet frame 136. Alternatively, the magnet frame 136 and the spring supporter 119 may be integrally formed, and the mount member 290 may be coupled to the magnet frame 136 or the spring supporter 119 formed integrally.

The mount member 290 according to the third embodiment has a difference in some structures from the mount member 280 according to the second embodiment.

The mount member 290 may include a support plate 291 coupled to the spring supporter 119 or the magnet frame 136, and a mount member extension part extending forward from the support plate 291.

The mount member extension part may include a mount pipe 292 extending forward from one surface of the support plate 291, and a second coupling part 293 provided in the front of the mount pipe 292 and coupling with the bushing member 260-2.

The support plate 291 may be provided in a circular plate shape.

The outer circumferential part of the support plate 291 may be coupled with the spring supporter 119. For example, a coupling part 291*b* having a cylindrical shape may extend at the rear of the support plate 291, and the coupling part 291*b* of the support plate 291 is inserted and fitted into the coupling part 119*b* of the spring supporter 119. In other words, the coupling part 119*b* of the spring supporter 119 may support two or more points of the outer circumferential surface of the coupling part 291*b* of the support plate 291.

Meanwhile, the support plate 291 may be coupled to the spring supporter 119 or the magnet frame 136 together with the muffler unit 160. For example, the coupling part 291*b* of the support plate 291 may be inserted and fitted into the front opening of the muffler unit 160, and the front portion of the muffler unit 160 can be inserted and fitted into the coupling part 119*b* of the spring supporter 119.

The mount pipe 292 may have a pipe shape extending through the support plate 291.

For example, the mount pipe 292 extends forward from the center of the support plate 291 along the center of the guide member 250-2 and may extend to be spaced apart from the head 251.

In other words, the mount pipe 292 may be prevented from contacting the head 251.

The mount pipe 292 may extend rearward from the center of the support plate 291 along the center of the muffler unit 160. In this case, the inlet of the mount pipe 292 may be disposed on the same axis as the outlet of the muffler unit 160.

The mount pipe 292 may function as a communication path through which the refrigerant flowing from the muffler unit 160 can pass.

The second coupling part 293 may be formed in the shape of a protrusion protruding outward from the front part of the mount pipe 292 in the radial direction. In other words, the second coupling part 293 may be defined as a coupling protrusion.

The second coupling part 293 may have a flange shape protruding in a radial direction from the front outer circumferential surface of the mount pipe 292. In this case, the second coupling part 293 may be inserted into and coupled to the inner coupling groove 262-1 of the bushing member 260-2.

The bushing member 260-2 may include a ring-shaped body 261-1 surrounding the mount pipe 292, an outer coupling part coupled to the first coupling part 256-2 which is formed on the inner circumferential surface of the guide member 250, and an inner coupling part coupled to the second coupling part 293.

Referring to FIG. 11, the outer coupling part may include the outer coupling groove 263-1 coupled to the first coupling part 256-2 in the form of a protrusion formed on the inner circumferential surface of the guide member 250-2, and the inner coupling part may include an inner coupling groove 262-1 coupled to the second coupling part 293 of a protrusion shape.

Meanwhile, the outer coupling groove 263-1 of the bushing member 260-2 and the shape of the protrusion of the first coupling part 256-2 of the guide member 250-2 may change positions. In other words, a protrusion-shaped outer coupling part may be formed on the bushing member 260-2 and a groove into which the protrusion is inserted may be formed on an inner circumferential surface of the guide member 250-2.

The bushing member 260-2 may be located at or in front of the central part of the guide member 250-2. In other words, the first coupling part 256-2 formed on the inner circumferential surface of the guide member 250-2 may be located at or in front of the central part of the guide member 250-2.

The rear end part of the guide member 250-2 is disposed to be spaced apart from the support plate 291. Therefore, when the bushing member 260-2 is elastically deformed by the force applied to the guide member 250-2, it is possible to prevent the guide member 250-2 from colliding with the support plate 291.

However, the gap between the guide member 250-2 and the support plate 291 may be minimized only to allow the relative displacement of the guide member 250-2. In addition, the diameter of the support plate 291 may be equal to or larger than the diameter of the guide member 250-2.

The bushing member 260-2 may allow displacement of the guide member 250-2 in the axial direction and also allow displacement of the guide member 250-2 in the circumferential direction. In other words, the bushing member 260-2 is deformed by transmitting contact pressure, the pressure of the lubrication surface, applied to the guide member 250-2, or the like, and the posture of the piston 150-2 is variably changed by the deformation of the bushing member 260-2. As such, by securing the degree of freedom of the guide member 250-2, the alignment of the guide member 250-2 can be satisfied with only the pressure generated on the lubrication surface between the piston 150-2 and the cylinder 140, and reliability and durability can be improved by minimizing the contact pressure. Therefore, the piston 150-2 can operate stably while minimizing misalignment in the cylinder 140.

Meanwhile, the combination of the groove, the locking jaw, and the sliding passage described above may be provided on any one of the outer or inner circumferential surface of the elastic member, the outer or inner circumferential surface of the guide member, and the outer or inner circumferential surface of the mount member, and in this case, the other one thereof coupled to any one thereof described above may be provided with a protrusion inserted into the groove.

In addition, a stopper may be additionally provided in any one thereof described above.

Certain or other embodiments of the present discloser described above are not mutually exclusive or distinct. In certain or other embodiments of the present discloser described above, their respective configurations or functions may be used together or combined.

For example, it means that configuration A described in a specific embodiment and/or drawing may be combined with configuration B described in another embodiment and/or drawing. In other words, even if the combination between the configurations is not directly described, it means that the combination therebetween is possible except for a case of being described that the combination therebetween is not possible.

The above-detailed description should not be construed as restrictive in all respects and should be considered as illustrative. The scope of the present discloser should be determined by reasonable interpretation of the appended claims, and all changes within the equivalent scope of the present discloser are included in the scope of the present disclosure.

The compressor according to the present disclosure reduces the contact pressure acting on the piston and minimizes the misalignment of the piston by adding a bushing capable of elastic deformation to the coupling part of the piston and generating variable elastic deformation in the bushing according to the surrounding environment, reduces friction or wear between the cylinder and the piston to maintain an appropriate clearance between the piston and the cylinder, and thus it is possible to improve compression reliability.

What is claimed is:

1. A compressor comprising:

a piston structure that includes a guide member, wherein the guide member is configured to reciprocate inside a cylinder, and a magnet frame that supports a mover, the mover being configured to move together with the piston structure, wherein the piston structure further comprises:

a mount member that is connected to the magnet frame; and an elastic member that is disposed between the guide member and the mount member and configured to elastically deform, wherein the guide member includes:

a guide that has a cylindrical shape, a head that is disposed at a first side of the guide and configured to compress a compression space inside the cylinder, and an extension part that extends from a second side of the guide and has a radius smaller than a radius of the guide, wherein the elastic member has an annular shape, wherein an outer circumferential surface of the elastic member is coupled to an inner circumferential surface of the mount member, and wherein an inner circumferential surface of the elastic member is coupled to an outer circumferential surface of the extension part.

2. The compressor of claim 1, wherein the guide member further includes:

a first coupling part that is disposed at the extension part and coupled to the inner circumferential surface of the elastic member, the second side being opposite to the first side.

3. The compressor of claim 2, wherein the mount member includes:

a mount member body part that at least partially surrounds the elastic member, a frame coupling part that extends from the mount member body part in an outer radial direction and is connected to the magnet frame, and a second coupling part that is disposed at an inner circumferential surface of the mount member body part.

4. The compressor of claim 3, wherein the elastic member includes an inner coupling part that is coupled to the first coupling part of the guide member on the inner circumferential surface of the elastic member, and wherein the elastic member includes an outer coupling part that is coupled to the second coupling part of the mount member body part on the outer circumferential surface of the elastic member.

5. The compressor of claim 1, wherein the elastic member is configured to deform based on tilting of the guide member in a radial direction and rotation of the guide member in a rotation direction.

6. The compressor of claim 5, wherein the elastic member includes a rubber material that has a shore D hardness of 30 or more.

7. A compressor comprising:

a piston structure that includes a guide member, wherein the guide member is configured to reciprocate inside a cylinder, and a magnet frame that supports a mover, the mover being configured to move together with the piston structure, wherein the piston structure further comprises:

a mount member that is connected to the magnet frame, and an elastic member that is disposed between the guide member and the mount member and configured to elastically deform, wherein the guide member has a cylindrical shape, wherein the elastic member has an annular shape, wherein an outer coupling part is disposed circumferentially at an outer circumferential surface of the elastic member, wherein an inner coupling part is disposed circumferentially at an inner circumferential surface of the elastic member, wherein the outer coupling part includes an outer coupling groove or an outer coupling protrusion that is coupled to one of the guide member or the mount member, and wherein the inner coupling part includes an inner coupling groove or an inner coupling protrusion that is coupled to the other of the guide member or the mount member.

8. The compressor of claim 7, wherein the inner coupling part is the inner coupling groove, and an inner sliding passage is (i) configured to receive a first coupling protrusion positioned at an outer circumferential surface of one of the guide member or the mount member and (ii) defined at an inner locking jaw that is located at a side of the inner coupling groove, or wherein the outer coupling part is the outer coupling protrusion, and a sliding passage is (i) configured to receive the outer coupling protrusion and (ii) defined at a locking jaw that is located at a side of a coupling groove defined at the other of the guide member or the mount member.

9. The compressor of claim 7, wherein the inner coupling part is the inner coupling groove, and the elastic member includes:

an inner sliding passage that is defined at an inner locking jaw located at a side of the inner coupling groove and configured to receive a first coupling protrusion positioned at an outer circumferential surface of one of the guide member or the mount member, and a first stopper that protrudes from the inner coupling groove and prevents rotation of the first coupling protrusion, or wherein the outer coupling part is the outer coupling groove, and the elastic member includes:

an outer sliding passage that is defined at an outer locking jaw located at a side of the outer coupling groove and configured to receive a second coupling protrusion positioned at an inner circumferential surface of the other of the guide member or the mount member, and a second stopper that protrudes from the outer coupling groove and prevents rotation of the second coupling protrusion.

10. The compressor of claim 7, wherein the inner coupling part is the inner coupling groove, and the outer coupling part is the outer coupling groove, and the elastic member defines the outer coupling groove and the inner coupling groove, wherein a width of the outer coupling groove is 1.5 or more times a depth of the outer coupling groove, and wherein a width of the inner coupling groove is 1.5 or more times a depth of the inner coupling groove.

* * * * *